US012240726B2

(12) United States Patent
Furuhashi

(10) Patent No.: US 12,240,726 B2
(45) Date of Patent: Mar. 4, 2025

(54) SHEET PROCESSING APPARATUS, IMAGE FORMING APPARATUS, AND IMAGE FORMING SYSTEM

(71) Applicant: Tomohiro Furuhashi, Kanagawa (JP)

(72) Inventor: Tomohiro Furuhashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 23 days.

(21) Appl. No.: 18/254,075

(22) PCT Filed: Jan. 14, 2022

(86) PCT No.: PCT/IB2022/050283
§ 371 (c)(1),
(2) Date: May 23, 2023

(87) PCT Pub. No.: WO2022/175756
PCT Pub. Date: Aug. 25, 2022

(65) Prior Publication Data

US 2024/0002186 A1 Jan. 4, 2024

(30) Foreign Application Priority Data

Feb. 16, 2021 (JP) ..... 2021-022618
Dec. 3, 2021 (JP) ..... 2021-197026

(51) Int. Cl.
*B65H 45/14* (2006.01)

(52) U.S. Cl.
CPC ..... *B65H 45/142* (2013.01); *B65H 2403/21* (2013.01); *B65H 2403/72* (2013.01);
(Continued)

(58) Field of Classification Search
CPC ..... B65H 2404/14; B65H 45/142; B65H 2513/412; B65H 2403/72
See application file for complete search history.

(56) References Cited

U.S. PATENT DOCUMENTS

2005/0092440 A1 5/2005 Lindsay et al.
2009/0039593 A1 2/2009 Kikkawa et al.
(Continued)

FOREIGN PATENT DOCUMENTS

JP 2004-189453 7/2004
JP 2014-101164 6/2014
(Continued)

OTHER PUBLICATIONS

International Search Report and Written Opinion issued on Apr. 26, 2022 in PCT/IB2022/050283 filed on Jan. 14, 2022.

*Primary Examiner* — Jennifer Bahls
(74) *Attorney, Agent, or Firm* — Harness, Dickey & Pierce, P.L.C.

(57) ABSTRACT

A sheet processing apparatus includes a plurality of roller pairs, a single driving force supply source, and a drive transmission mechanism. The plurality of roller pairs include a first roller pair, a second roller pair, and a third roller pair. The single driving force supply source supplies a driving force to the first roller pair, the second roller pair, and the third roller pair. The drive transmission mechanism transmits the driving force to the first roller pair and the second roller pair in a manner such that a rotation direction of the first roller pair is not switched even in a case in which a direction of the driving force is switched such that a rotation direction of the second roller pair is switched when the first roller pair and the second roller pair are driven by the driving force from the driving force supply source.

9 Claims, 29 Drawing Sheets

(52) U.S. Cl.
CPC .... *B65H 2404/14* (2013.01); *B65H 2513/412* (2013.01); *B65H 2801/27* (2013.01)

(56) References Cited

U.S. PATENT DOCUMENTS

| | | | | |
|---|---|---|---|---|
| 2011/0103921 | A1 | 5/2011 | Suzuki et al. | |
| 2011/0248440 | A1 | 10/2011 | Sugiyama et al. | |
| 2011/0294639 | A1 | 12/2011 | Imazu et al. | |
| 2012/0267846 | A1 | 10/2012 | Nakada et al. | |
| 2014/0141956 | A1 | 5/2014 | Suzuki et al. | |
| 2015/0031520 | A1 | 1/2015 | Nakada et al. | |
| 2015/0321871 | A1 | 11/2015 | Nakagawa et al. | |
| 2017/0341885 | A1* | 11/2017 | Suzuki ..... | B65H 7/14 |
| 2019/0284012 | A1 | 9/2019 | Yoneyama et al. | |
| 2020/0341414 | A1 | 10/2020 | Watanabe et al. | |
| 2020/0407187 | A1 | 12/2020 | Hidaka et al. | |
| 2021/0039900 | A1 | 2/2021 | Shimazu et al. | |
| 2021/0039916 | A1 | 2/2021 | Sugiyama et al. | |
| 2021/0253385 | A1 | 8/2021 | Yoshito et al. | |
| 2021/0289090 | A1 | 9/2021 | Monma et al. | |
| 2021/0294249 | A1 | 9/2021 | Takahashi et al. | |
| 2021/0325804 | A1 | 10/2021 | Furuhashi et al. | |
| 2021/0333730 | A1 | 10/2021 | Asano et al. | |
| 2021/0347160 | A1 | 11/2021 | Akiyama et al. | |
| 2021/0347589 | A1 | 11/2021 | Suzuki et al. | |
| 2021/0354948 | A1 | 11/2021 | Takahashi et al. | |
| 2021/0356899 | A1 | 11/2021 | Takahashi et al. | |

FOREIGN PATENT DOCUMENTS

| | | |
|---|---|---|
| JP | 2014-227284 | 12/2014 |
| JP | 2015-231908 | 12/2015 |

* cited by examiner

SHEET PROCESSING APPARATUS, IMAGE FORMING APPARATUS, AND IMAGE FORMING SYSTEM

TECHNICAL FIELD

Embodiments of the present disclosure relate to a sheet processing apparatus, an image forming apparatus, and an image forming system.

BACKGROUND ART

There is known a sheet processing apparatus to fold a sheet-shaped medium (hereinafter referred to as "sheet") into a predetermined form. Further, there are known an image forming apparatus to form an image on a sheet and an image forming system including a sheet processing apparatus to fold the sheet on which the image is formed.

Furthermore, a sheet processing apparatus is known that has a configuration in which among a plurality of roller pairs disposed in a conveyance path to convey a sheet, a roller pair for folding process is disposed between an upstream roller pair and a downstream roller pair, and a folding process is performed by controlling the plurality of roller pairs (e.g., Japanese Unexamined Patent Application Publication No. 2014-101164).

In the sheet processing apparatus of Japanese Unexamined Patent Application Publication No. 2014-101164, the rotation directions of the upstream roller pair and the downstream roller pair are controlled to bend a sheet between the plurality of roller pairs. The bent portion of the sheet is nipped between the plurality of roller pairs to apply the folding process.

CITATION LIST

Patent Literature

PTL 1

Japanese Unexamined Patent Application Publication No. 2014-101164

SUMMARY OF INVENTION

Technical Problem

In the sheet processing apparatus disclosed in Japanese Unexamined Patent Application Publication No. 2014-101164, the rotation direction of the downstream roller pair is reversed at a predetermined timing to change the conveyance direction in which the sheet is conveyed downstream. At this time, the rotation direction of the upstream conveying roller pair is not switched, and the rotation in the conveyance direction is maintained. Accordingly, the downstream roller pair disposed downstream from the roller pair for the folding process and the upstream roller pair disposed upstream from the roller pair for the folding process rotate in different directions. That is, in the sheet processing apparatus disclosed in Japanese Unexamined Patent Application Publication No. 2014-101164, multiple drive systems need to be provided separately for the respective roller pairs.

Further, in the sheet processing apparatus disclosed in Japanese Unexamined Patent Application Publication No. 2014-101164, if the speed at which the downstream roller pair conveys the sheet is slightly faster than the speed at which the upstream roller pair conveys the sheet, the sheet is pulled between the two roller pairs. In this case, suitable looseness is not formed, which causes a folding failure. The rotation direction of the upstream roller pair disposed upstream on the conveyance path in the conveyance direction and the rotation direction of the downstream roller pair disposed downstream on the conveyance path in the conveyance direction need to be controlled separately. The rotation speed of each roller pair also needs to be controlled separately. At this point, the drive systems need to be provided separately for the respective roller pairs.

That is, in the related art, multiple drive systems that functions to perform the folding process needs to be provided separately for the respective roller pairs, and there is a problem that the whole sheet processing apparatus is likely to be large. Further, in the drive control of each conveyance roller pair for the folding process, there is a problem that the control system for finely adjusting the sheet conveyance speed is complicated.

An object of the present disclosure is to provide a sheet processing apparatus having a configuration in which a plurality of roller pairs for performing folding process are driven by a single drive system, and the rotation direction of each roller pair can be switched individually.

Solution to Problem

To solve the above-described problems, a sheet processing apparatus includes a plurality of roller pairs, a single driving force supply source, and a drive transmission mechanism. The plurality of roller pairs convey a sheet from upstream to downstream in a sheet conveyance direction, and include a first roller pair, a second roller pair, and a third roller pair. The second roller pair is disposed downstream from the first roller pair in the sheet conveyance direction. The third roller pair is disposed between the first roller pair and the second roller pair and forms a crease on the sheet. The single driving force supply source supplies a driving force to the first roller pair, the second roller pair, and the third roller pair. The drive transmission mechanism transmits the driving force to the first roller pair and the second roller pair in a manner such that a rotation direction of the first roller pair is not switched even in a case in which a direction of the driving force is switched such that a rotation direction of the second roller pair is switched when the first roller pair and the second roller pair are driven by the driving force from the driving force supply source.

Advantageous Effects of Invention

According to the present disclosure, a plurality of roller pairs to perform a folding process can be driven by a single drive system, and the rotation directions of the plurality of roller pairs can be switched separately.

BRIEF DESCRIPTION OF DRAWINGS

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF EMBODIMENTS

Figure 1:
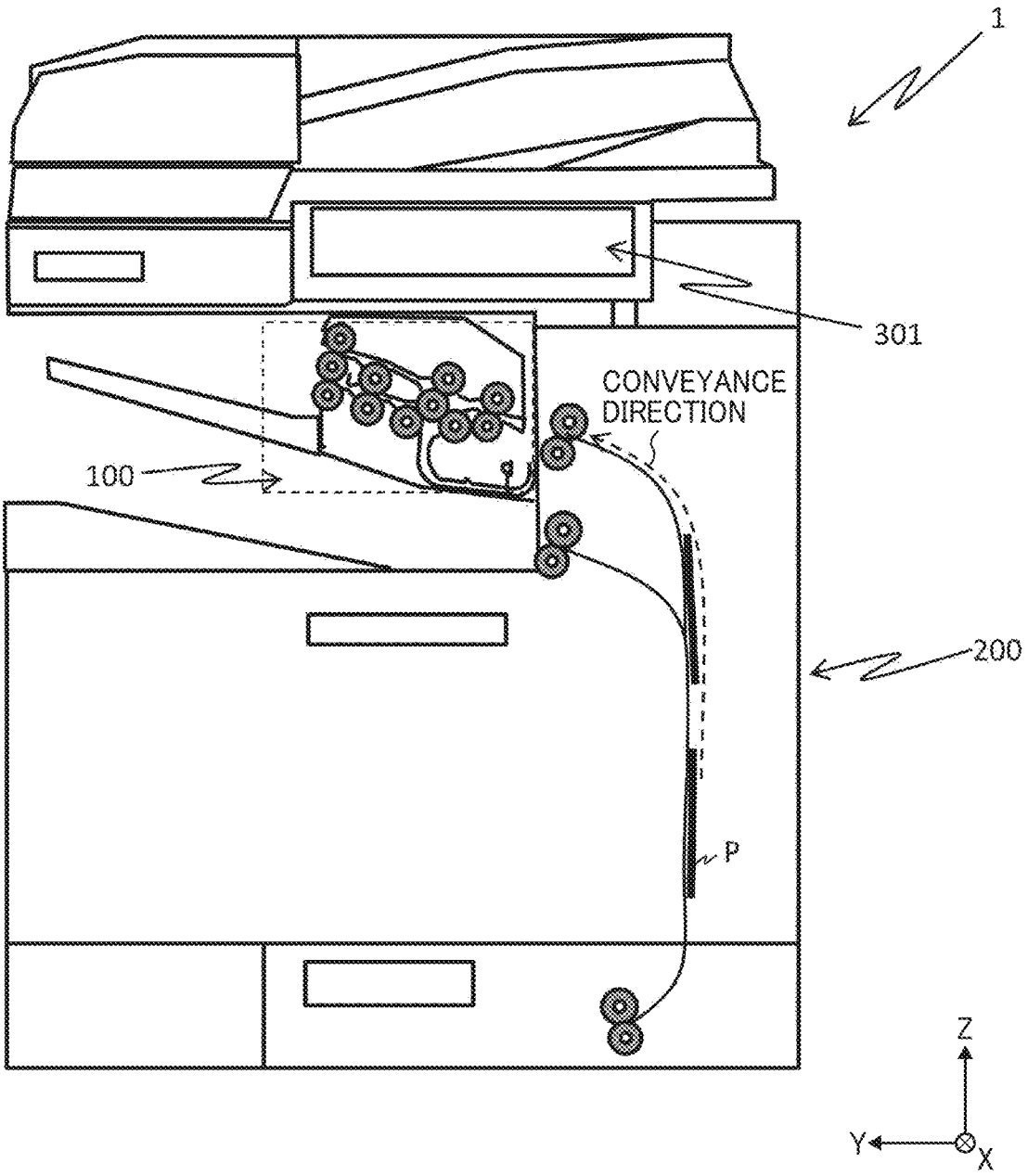
FIG. 1 is a schematic diagram illustrating a configuration of a printer serving as an image forming apparatus according to an embodiment of the present disclosure.

The terminology used herein is for the purpose of describing particular embodiments only and is not intended to be limiting of the present invention. As used herein, the singular forms "a," "an," and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

The present disclosure is configured so that a driving force to sandwich and reverse a conveyor provided in the original conveyance path is supplied by a single driving source. A folding of a sheet-shaped medium is performed with the driving force from the single drive source. Hereinafter, embodiments of the present disclosure are described with reference to the drawings.

Referring to FIG. 1, a description is given of an image forming apparatus according to an embodiment of the present disclosure. As illustrated in FIG. 1, a printer 1 serving as the image forming apparatus according to an embodiment of the present disclosure basically includes an image forming unit 200 and a sheet processing unit 100. The sheet processing unit 100 is one of a sheet processing device and a sheet processing apparatus according to embodiments of the present disclosure. Details of the sheet processing unit 100 are described later.

The image forming unit 200 conveys a sheet P from a sheet storage unit accommodating the sheet P as a sheet-shaped medium to an image forming section that forms an image on the sheet P. The image forming unit 200 includes a conveyance mechanism that discharges the sheet P to the sheet processing unit 100 after an image formation. As illustrated in FIG. 1, the printer 1 has, for example, a configuration that discharges the sheet P from right to left toward an operation panel 301 serving as an operation interface.

Figure 28:
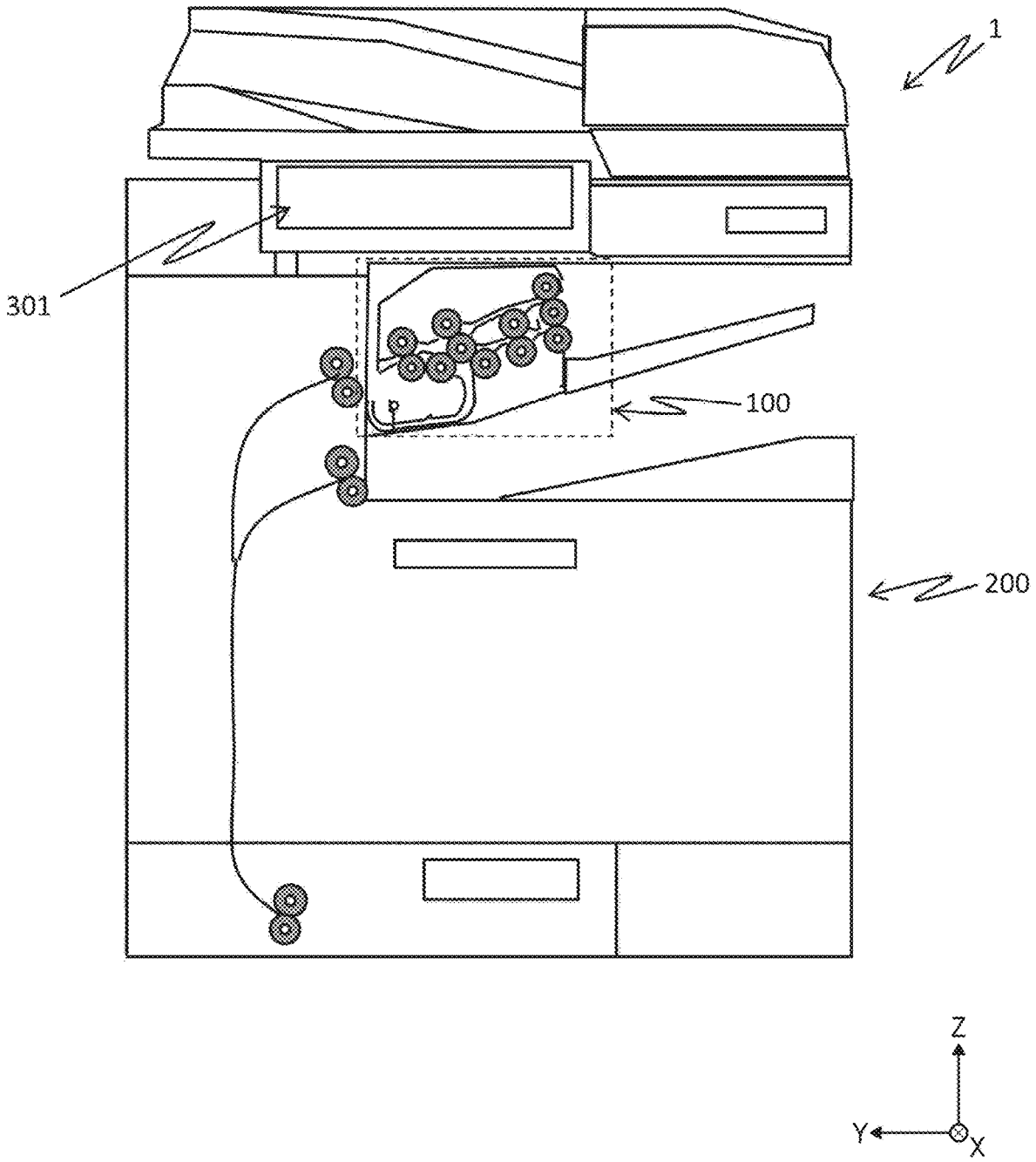
FIG. 28 is a schematic diagram illustrating a configuration of a printer serving as an image forming apparatus according to an embodiment of the present disclosure.
Figure 29:
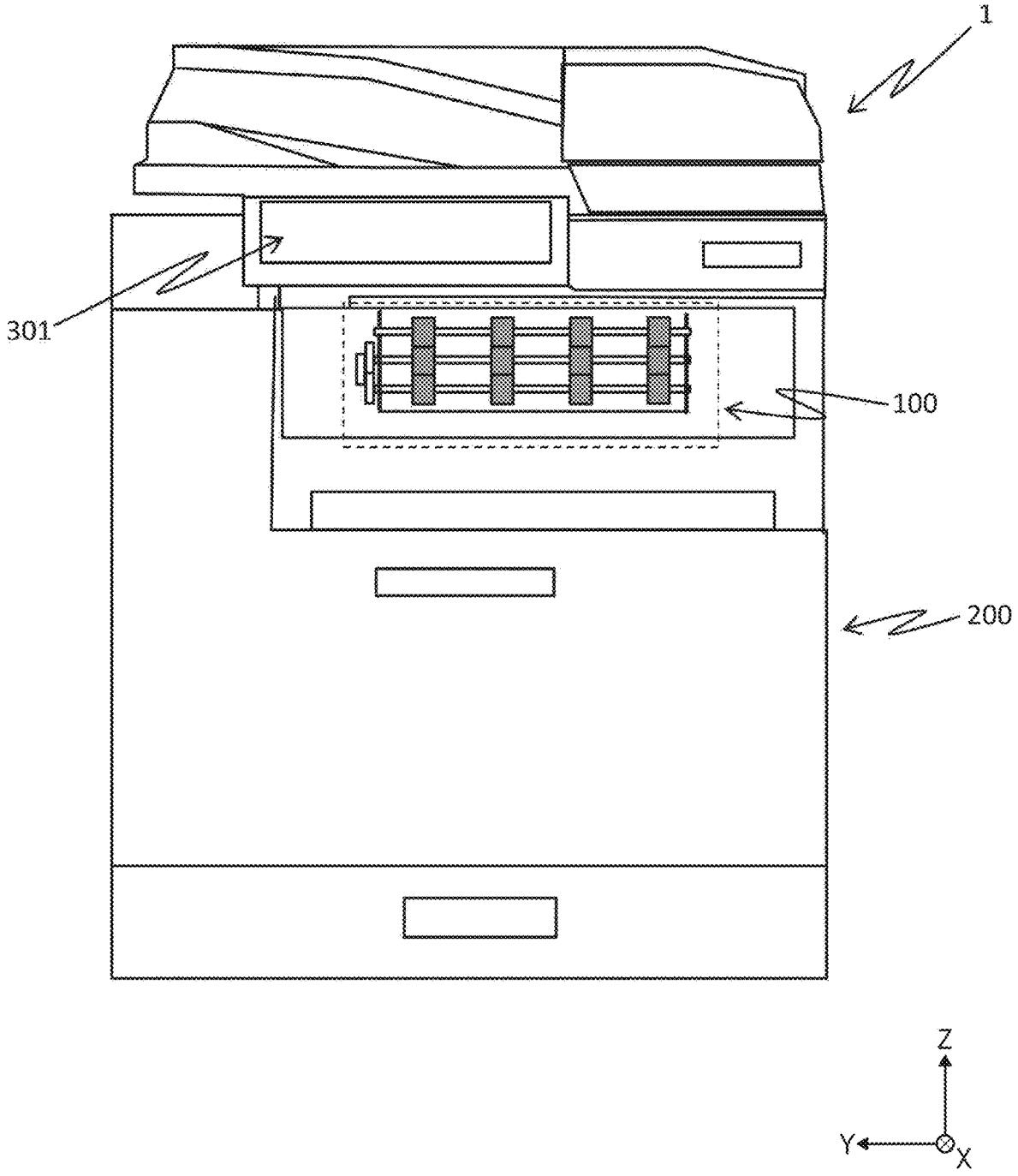
FIG. 29 is a schematic diagram illustrating a configuration of a printer serving as an image forming apparatus according to an embodiment of the present disclosure.

Hereinafter, embodiments of the present disclosure are premised on the configuration illustrated in FIG. 1. In addition to the configuration illustrated in FIG. 1, as illustrated in FIG. 28, a printer 1 serving as an image forming apparatus according to an embodiment of the present disclosure may have a configuration that discharges the sheet P from left to right toward the operation panel 301. Further, as illustrated in FIG. 29, a printer 1 serving as an image forming apparatus according to an embodiment of the present disclosure may have a configuration that discharges the sheet P from the back side to the front side toward the operation panel 301.

In any of the above-described embodiments, the sheet processing unit 100 is disposed at a discharge port where the sheet P is discharged from the image forming unit 200, thus allowing the sheet P to be folded and discharged. The sheet processing unit 100 may be detachably attached with respect to the image forming unit 200 or may be incorporated as a part of the image forming unit 200.

Figure 30:
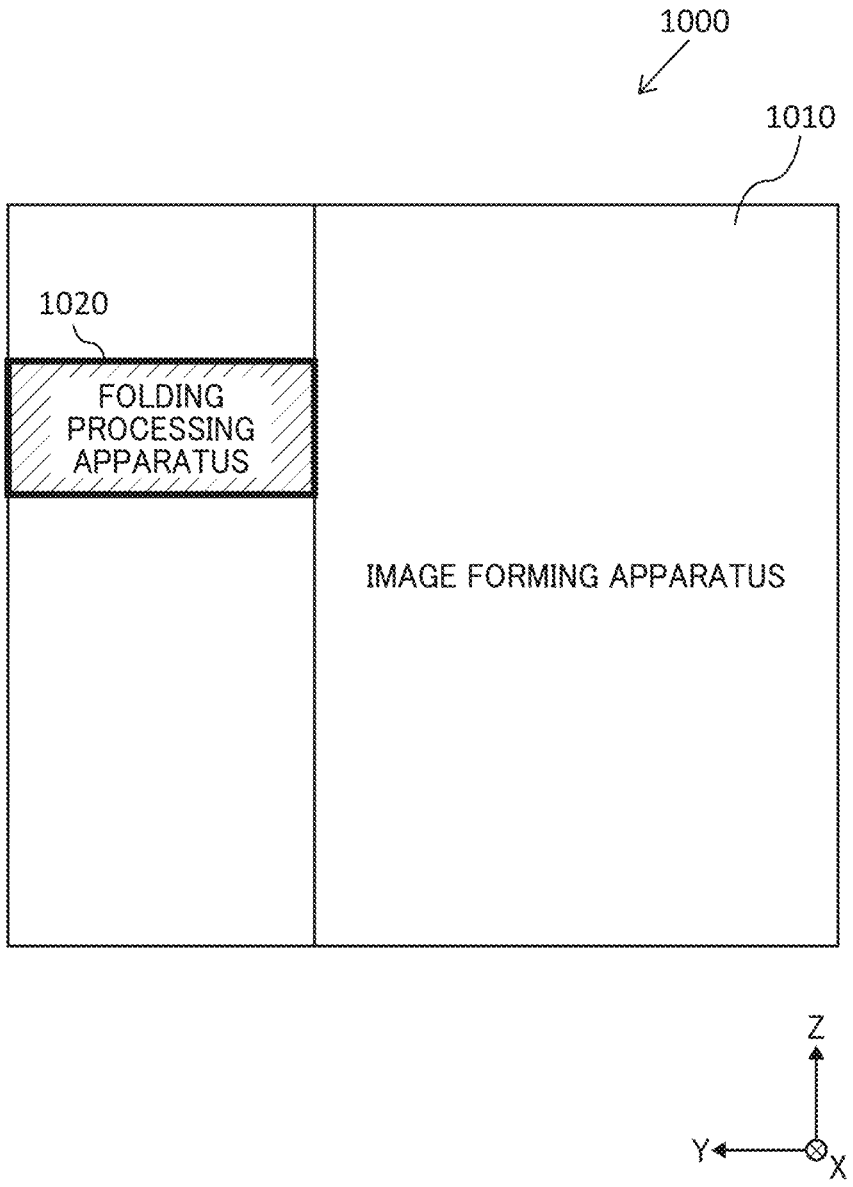
FIG. 30 is a schematic diagram illustrating a configuration of an image forming system according to an embodiment of the present disclosure.

FIG. 30 is a schematic diagram illustrating a configuration of an image forming system 1000 according to an embodiment of the present disclosure. In FIG. 30, the image forming system 1000 according to the present embodiment basically includes an image forming apparatus 1010 and a folding processing apparatus 1020 serving as the sheet processing apparatus. A sheet P on which an image is formed by the image forming apparatus 1010 is conveyed to the folding processing apparatus 1020. The folding processing apparatus 1020 performs a predetermined sheet folding operation to the sheet P and discharges the sheet P.

Figure 2:
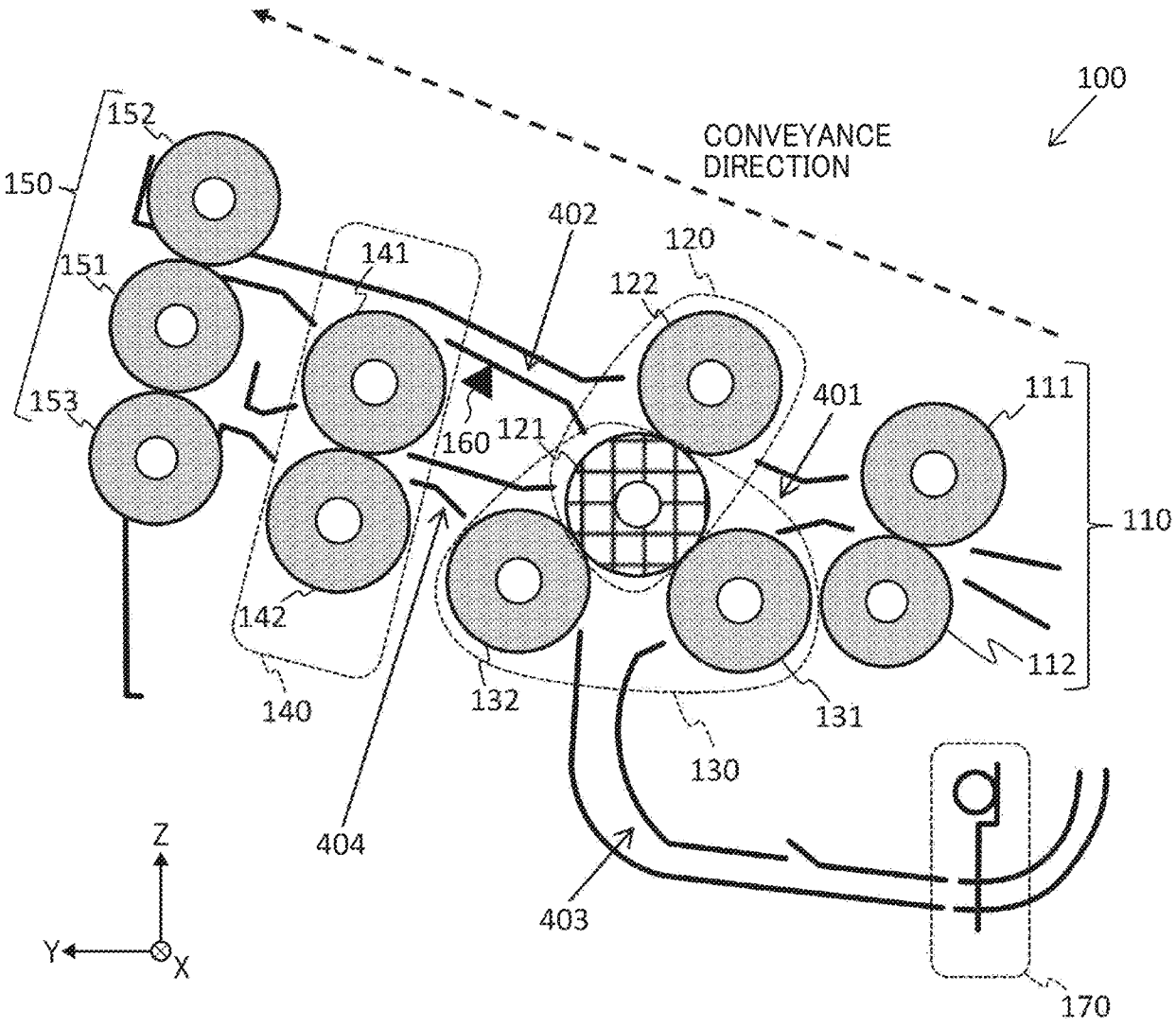
FIG. 2 is a schematic diagram illustrating a mechanism of a sheet processing unit according to an embodiment of the present disclosure.

FIG. 2 illustrates an outline of a conveyance mechanism and a folding processing mechanism provided in the sheet processing unit 100. As illustrated in FIG. 2, the sheet processing unit 100 includes a first conveyor 110, a second conveyor 120, a first folding roller section 130, a second folding roller section 140, a discharge roller section 150, a first sheet detector 160, and a second sheet detector 170. The sheet processing unit 100 includes a plurality of rollers and rotates a plurality of roller pairs including these rollers to fold a sheet P.

A conveyance path provided in the sheet processing unit 100 is distinguishable into a plurality of conveyance paths for convenience. A first conveyance path 401 is a conveyance path downstream from the first conveyor 110 and upstream from the second conveyor 120 in the conveyance direction of the sheet P to bend the sheet P when the sheet processing unit 100 forms a first crease on the sheet P. A second conveyance path 402 is a conveyance path downstream from the second conveyor 120 and includes a configuration of detecting an inversion timing of the sheet P when the sheet P is folded. A third conveyance path 403 is a conveyance path that branches from the first conveyance path 401. The sheet P on which the first crease is formed is conveyed to the third conveyance path 403. A fourth conveyance path 404 is a conveyance path that conveys the sheet P on which a second folding process has been performed in the first folding roller section 130 and includes a configuration of performing an additional-folding process.

The first conveyor 110 serving as a first conveying roller pair is disposed on the upstream side of the sheet processing unit 100 and disposed at a position to receive the sheet P discharged from the image forming unit 200. The first conveyor 110 includes a first conveying drive roller 111 and a first conveying driven roller 112. The first conveying drive roller 111 is a drive roller that rotates by a driving force from a drive motor 180 (serving as a driving force supply source). The first conveying driven roller 112 is a driven roller that rotates according to the rotation of the first conveying drive roller 111.

The first conveying roller pair including the first conveying drive roller 111 and the first conveying driven roller 112 nips the sheet P. The first conveying roller pair rotates by the driving force from the drive motor 180 to convey the sheet P. The rotation direction of the first conveying drive roller 111 is a direction to move the sheet P from the upstream side to the downstream side in the conveyance direction defined as a direction in which the sheet P is folded and discharged. The first conveyor 110 corresponds to an upstream conveying roller pair disposed on the upstream side in the conveyance direction.

The second conveyor 120 (serving as a second conveying roller) pair is disposed downstream from the first conveyor 110 in the conveyance direction in the sheet processing unit 100 and conveys the sheet P together with the first conveyor 110 in the conveyance direction. The second conveyor 120 conveys a downstream portion of the sheet P in reverse toward the upstream side in the conveyance direction to form a bend for the folding process in the sheet P.

Hereinafter, the rotation of each roller to convey the sheet P in the conveyance direction illustrated in FIG. 2 is referred to as "forward rotation" or "rotate forward". The rotation of each roller to convey the sheet P in the direction opposite to the conveyance direction is referred to as "reverse rotation" or "rotate in reverse". The forward rotation corresponds to rotation in a first direction, and the reverse rotation corresponds to rotation in a second direction.

The second conveyor 120 includes a second conveying drive roller 121 and a second conveying driven roller 122. The second conveying drive roller 121 is a drive roller that rotates by a driving force from the drive motor 180. The second conveying driven roller 122 is a driven roller that rotates according to the rotation of the second conveying drive roller 121.

The second conveying roller pair including the second conveying drive roller 121 and the second conveying driven roller 122 nips the sheet P. The second conveying roller pair rotates by the driving force from the drive motor 180 to convey the sheet P. The second conveying drive roller 121 rotates in two directions, that is, a direction to move the sheet P in the conveyance direction and a direction to reverse a downstream portion of the sheet P to the upstream side. The second conveyor 120 corresponds to a downstream conveying roller pair disposed downstream from the first conveyor 110 in the conveyance direction defined as a direction in which the sheet P is folded and discharged.

The first folding roller section 130 is disposed between the first conveyor 110 serving as the upstream conveying roller pair and the second conveyor 120 serving as the downstream conveying roller pair. The first folding roller section 130 serving as a third roller pair includes a first folding roller pair and a second folding roller pair. The first folding roller pair includes the second conveying drive roller 121 and a first folding roller 131. The second folding roller pair includes the second conveying drive roller 121 and a second folding roller 132. The first folding roller 131 and the second folding roller 132 are driven rollers that are rotated by the rotation of the second conveying drive roller 121.

The second conveying drive roller 121 is rotated in a predetermined direction by the driving force from the drive motor 180, with the first folding roller pair nipping the sheet P, to form the first crease on the sheet P. The sheet P on which the first crease is formed is conveyed to the third conveyance path 403. The second conveying drive roller 121 is rotated in a predetermined direction by the driving force from the drive motor 180, with the second folding roller pair nipping the sheet P on which the first crease is formed, to form a second crease on the sheet P. The sheet P on which the second crease is formed is conveyed to the fourth conveyance path 404.

Since the first folding roller section 130 executes the folding process on the sheet P by the rotation of the second conveying drive roller 121 that functions as the drive roller, the folding process of the sheet P is controlled according to the rotation direction and the rotation speed of the second conveying drive roller 121.

The second folding roller section 140 is disposed downstream from the first folding roller section 130 in the conveyance direction on the fourth conveyance path 404. The second folding roller section 140 includes an additional-folding drive roller 141 and an additional-folding driven roller 142. The additional-folding drive roller 141 is rotated by the driving force from the drive motor 180 in the predetermined direction. The additional-folding driven roller 142 is rotated according to the rotation of the additional-folding drive roller 141 in the predetermined direction. The additional-folding drive roller 141 and the additional-folding driven roller 142 are rotated with the sheet P on which the crease is formed is nipped in the first folding roller section 130, to perform an additional-folding process on the sheet P. The sheet P on which the additional-folding process is performed is conveyed to the discharge roller section 150.

The discharge roller section 150 includes a first discharge roller 151, a second discharge roller 152, and a third discharge roller 153. The first discharge roller 151 is a drive roller that is rotated by a driving force from the drive motor 180. The second discharge roller 152 and the third discharge roller 153 are driven rollers that are rotated by the rotation of the first discharge roller 151.

When the sheet P that is conveyed by the first conveyor 110 and the second conveyor 120 through the second conveyance path 402 is discharged without a folding process, the sheet P is nipped and discharged by the first discharge roller 151 and the second discharge roller 152. The sheet P that has been additionally folded in the second folding roller section 140 is nipped between and discharged by the first discharge roller 151 and the third discharge roller 153.

The first sheet detector 160 is a sensor that detects a leading end of the sheet P conveyed by the first conveyor 110 and the second conveyor 120 and is disposed on the second conveyance path 402. When the sheet P is folded, the first sheet detector 160 defines the switching timing at which the rotation direction of the second conveying drive roller 121 is changed after the sheet P is conveyed in the downstream direction by a predetermined amount from the detection of the leading end of the sheet P with the first sheet detector 160. When the first folding roller section 130 forms a crease on the sheet P, the rotation direction of the second conveying drive roller 121 is changed at a timing that the sheet P is conveyed by a predetermined amount from the detection of the leading end of the sheet P with the first sheet detector 160. As a result, the sheet P is bent between the first conveyor 110 and the second conveyor 120, and the bent portion is guided to the first folding roller section 130, thus allowing the first folding roller section 130 to perform the folding process.

The second sheet detector 170 is a leading end stopper that detects an end portion of the sheet P on which a crease is formed after passage between the second conveying drive roller 121 and the first folding roller 131. The second sheet detector 170 is disposed on the third conveyance path 403. When the leading end of the sheet P contacts the second sheet detector 170 and stops, a bend is formed on the sheet P pushed from the upstream in the vicinity of the first folding roller section 130. This bend (i.e., a part of the rear end of the sheet P) is nipped between the second conveying drive roller 121 and the second folding roller 132, and the second folding process is performed. The sheet P on which the second folding process is performed is conveyed to the second folding roller section 140 via the fourth conveyance path 404 by the driving force of the second conveying drive roller 121.

Figure 23A:
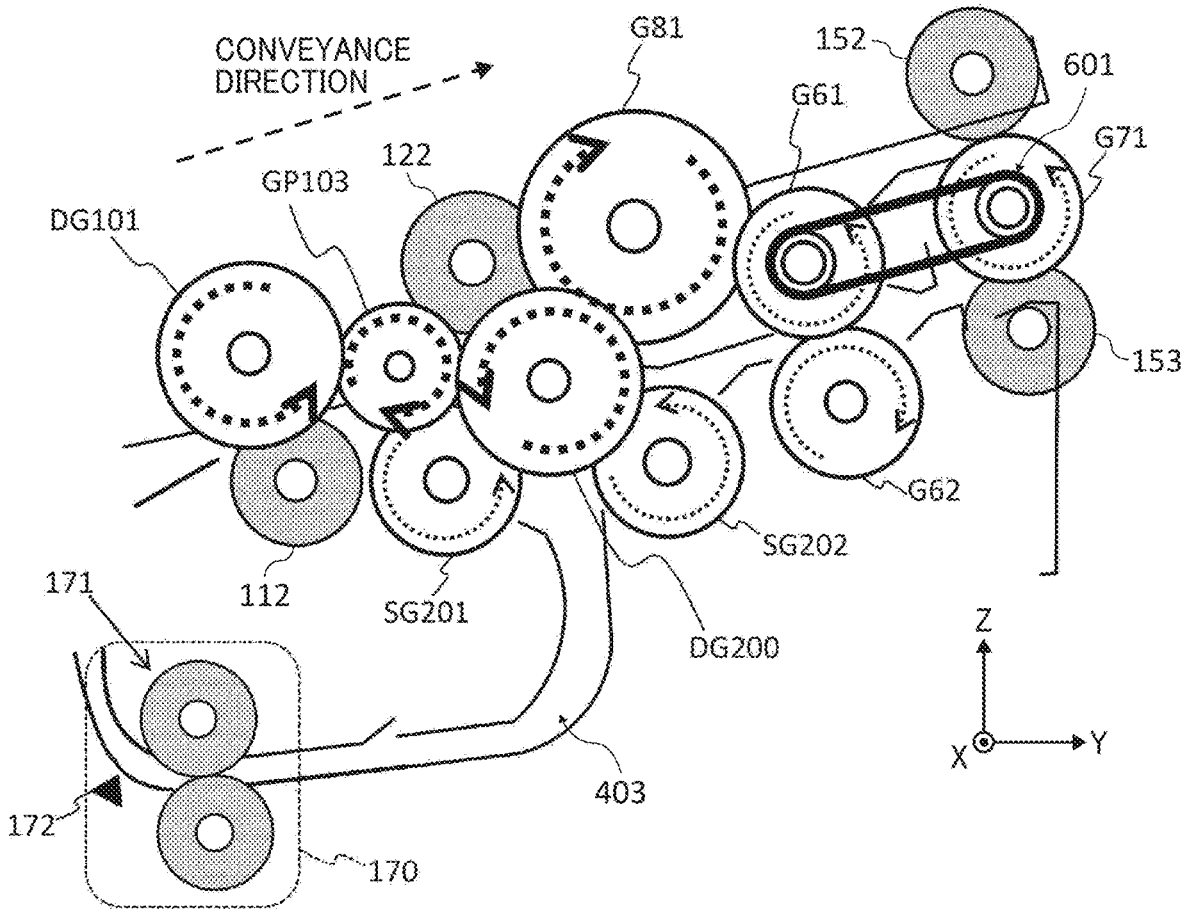
FIG. 23A is a schematic diagram illustrating a drive transmission system in a folding process of a sheet processing unit according to a third embodiment.
Figure 23B:
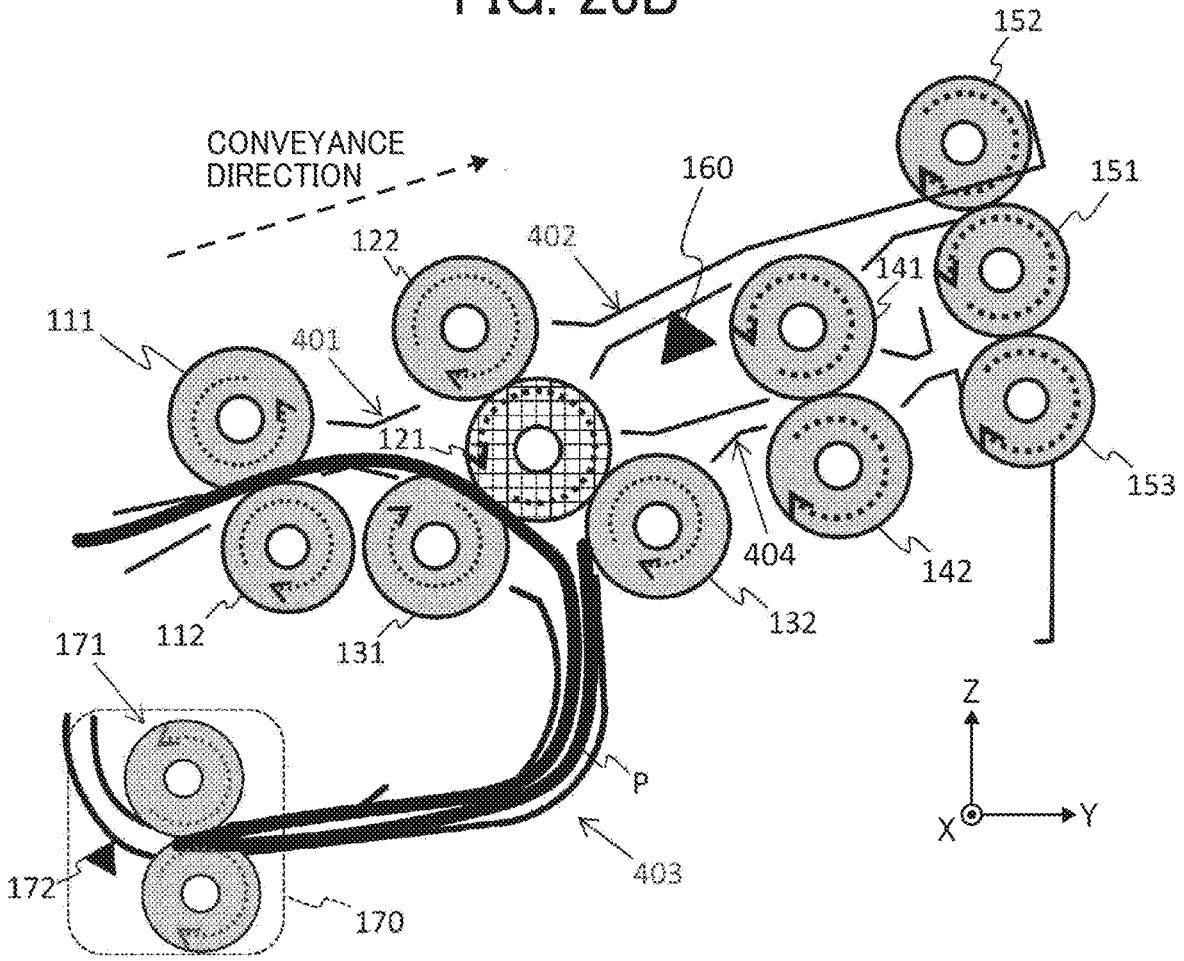
FIG. 23B is a schematic diagram illustrating conveying roller pairs in the folding process of the sheet processing unit according to the third embodiment.

As illustrated in FIGS. 23A and 23B, the second sheet detector 170 is not limited to the leading end stopper and may be configured with a sensor and a roller pair whose rotation direction can be controlled, similarly to the first sheet detector 160.

Figure 3:
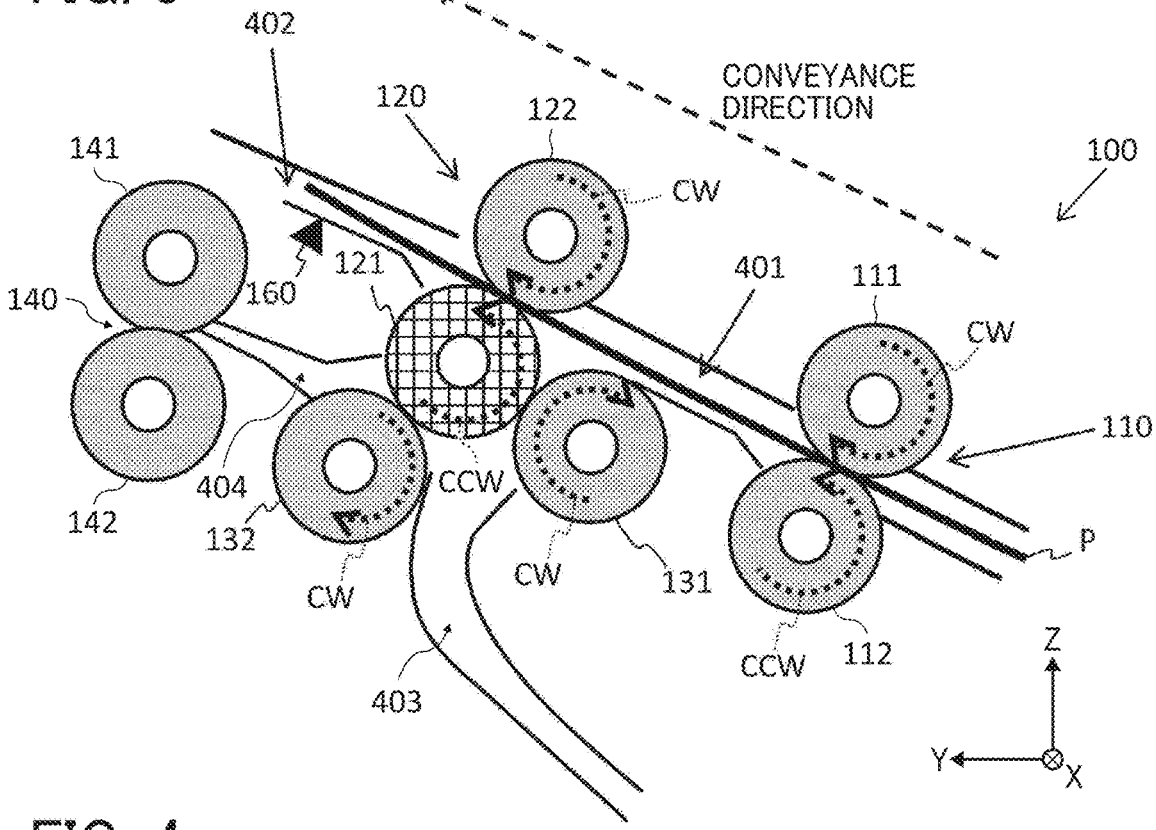
FIG. 3 is a schematic diagram illustrating a folding operation of the sheet processing unit.

An outline of operations performed when the sheet processing unit 100 performs the folding process is described with reference to FIGS. 3 to 7. As illustrated in FIG. 3, the sheet P is conveyed into the sheet processing unit 100 and is conveyed in the downstream direction by the first conveyor 110 and the second conveyor 120. The rotation direction of the second conveying drive roller 121 at this time is a counterclockwise (CCW) direction when the second conveying drive roller 121 is viewed from the positive direction of the X axis with respect to the Y-Z plane in FIG. 3. The rotation direction of the second conveying driven roller 122 driven by the second conveying drive roller 121 is a clockwise (CW) direction when the second conveying driven roller 122 is similarly viewed from the positive direction of the X axis with respect to the Y-Z plane. FIGS. 4 to 8 are also viewed from the same direction.

Figure 4:
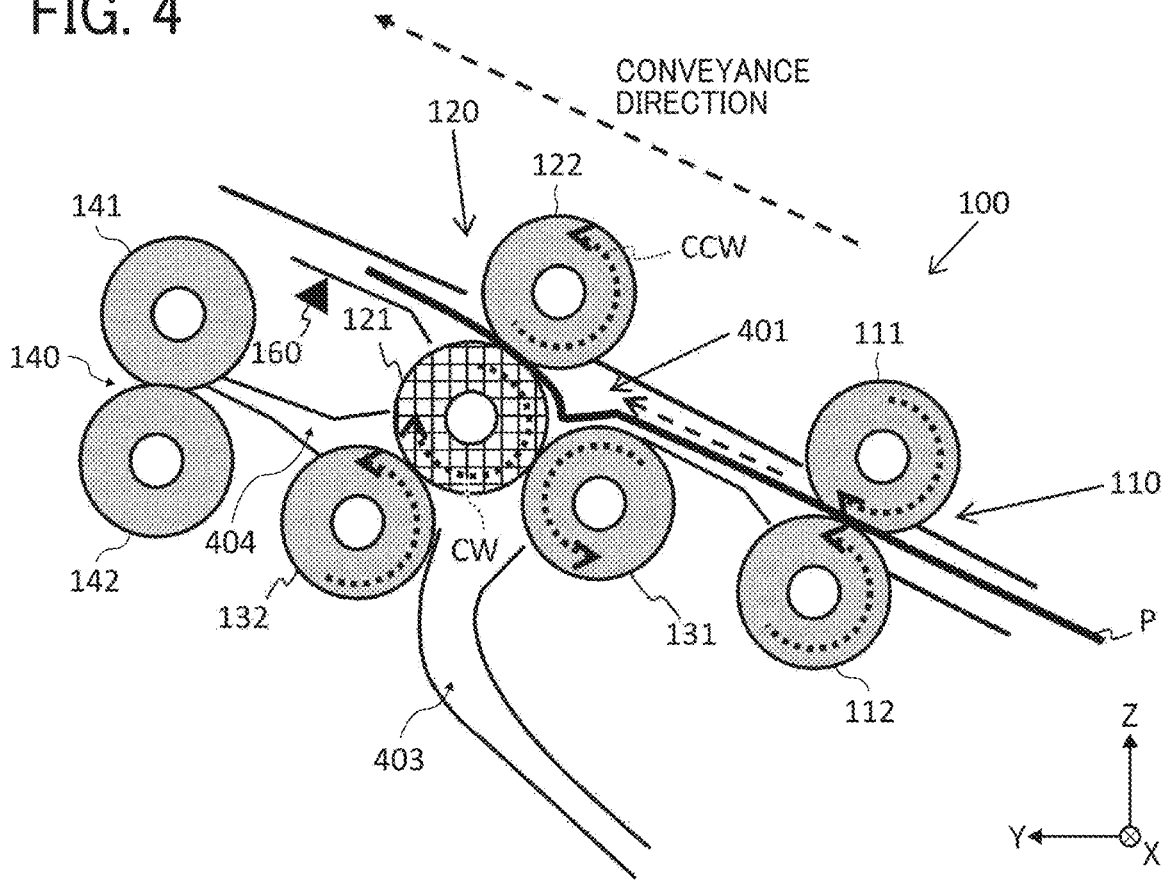
FIG. 4 is a schematic diagram illustrating the folding operation of the sheet processing unit illustrated in FIG. 3.

Similarly, in FIG. 3, the rotation direction of the first conveying drive roller 111 is the CW direction, and the rotation direction of the first conveying driven roller 112 is the CCW direction. That is, the sheet P nipped in the first conveyor 110 is conveyed in the conveyance direction. The leading end of the sheet P nipped by the second conveyor 120 is also conveyed to the second conveyance path 402. Thereafter, the leading end of the sheet P is detected by the sensor of the first sheet detector 160. After the sheet P is conveyed by a certain distance from the detection of the leading end, the rotation direction of the second conveying drive roller 121 is reversed to be the CW direction as illustrated in FIG. 4.

Even if the rotation direction of the second conveying drive roller 121 is switched from the CCW direction to the CW direction, the rotation direction of the first conveying drive roller 111 is not switched and is maintained to be the CW direction. At this time, a downstream portion of the sheet P in the conveyance direction is conveyed in reverse from the downstream to the upstream. An upstream portion of the sheet P is conveyed from the upstream to the downstream as before. As a result, the sheet P is bent between the second conveyor 120 and the first conveyor 110. If this bent portion is formed toward the first folding roller section 130, the state of the sheet P shifts to such a state as illustrated in FIG. 5.

Figure 5:
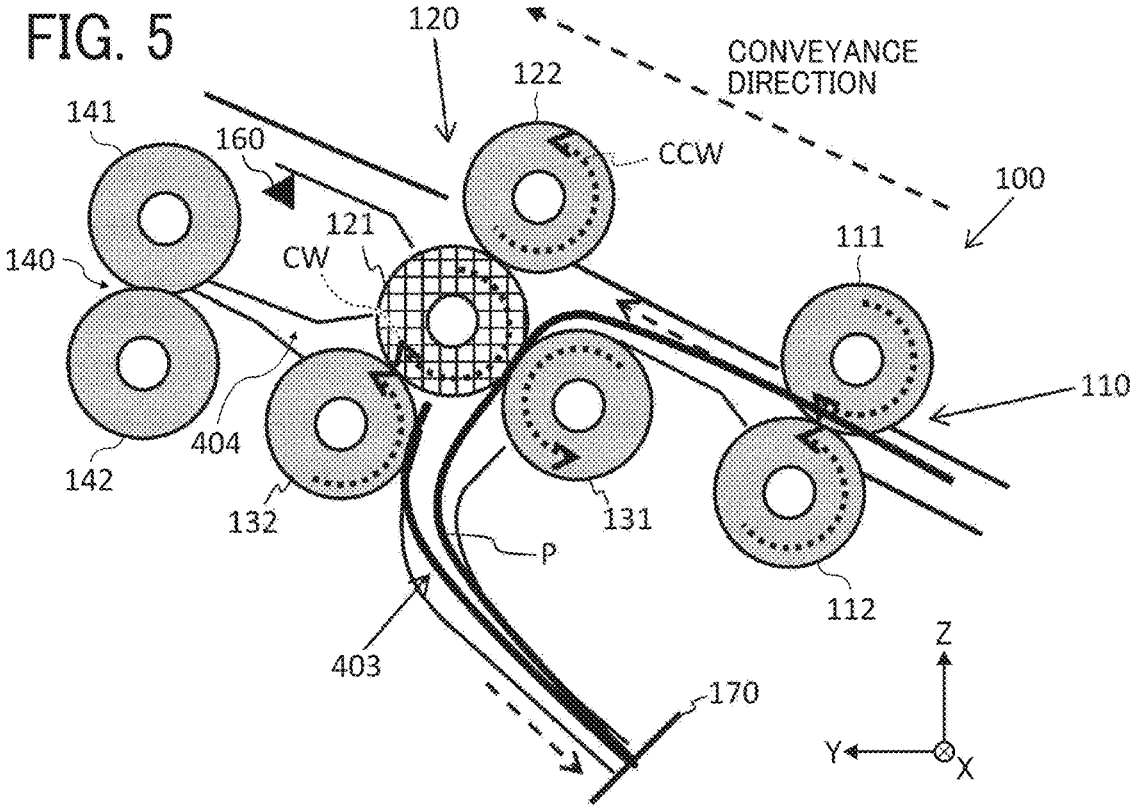
FIG. 5 is a schematic diagram illustrating the folding operation of the sheet processing unit illustrated in FIG. 3.

As illustrated in FIG. 5, the bent portion of the sheet P is nipped between the second conveying drive roller 121 and the first folding roller 131. The bent portion of the sheet P passes through the nip of the second conveying drive roller 121 and the first folding roller 131 due to the rotation of the second conveying drive roller 121, so that the first crease is formed. At this time, the conveyance direction of the sheet P by the first conveyor 110 is as before. The upstream portion of the sheet P is conveyed in the direction as before. The downstream portion of the sheet P passes through the first folding roller section 130 and is conveyed to the third conveyance path 403 branching from the first conveyance path 401.

After that, the end portion (i.e., the portion where the crease is formed) of the sheet P on the third conveyance path 403 side contacts the leading end stopper as the second sheet detector 170 (see FIG. 2) and stops. At this time, the upstream portion of the sheet P is continuously conveyed to the third conveyance path 403 by the first conveyor 110, the second conveying drive roller 121, and the first folding roller 131. As a result, the sheet P is bent in the vicinity of the second conveying drive roller 121 and the second folding roller 132.

Figure 6:
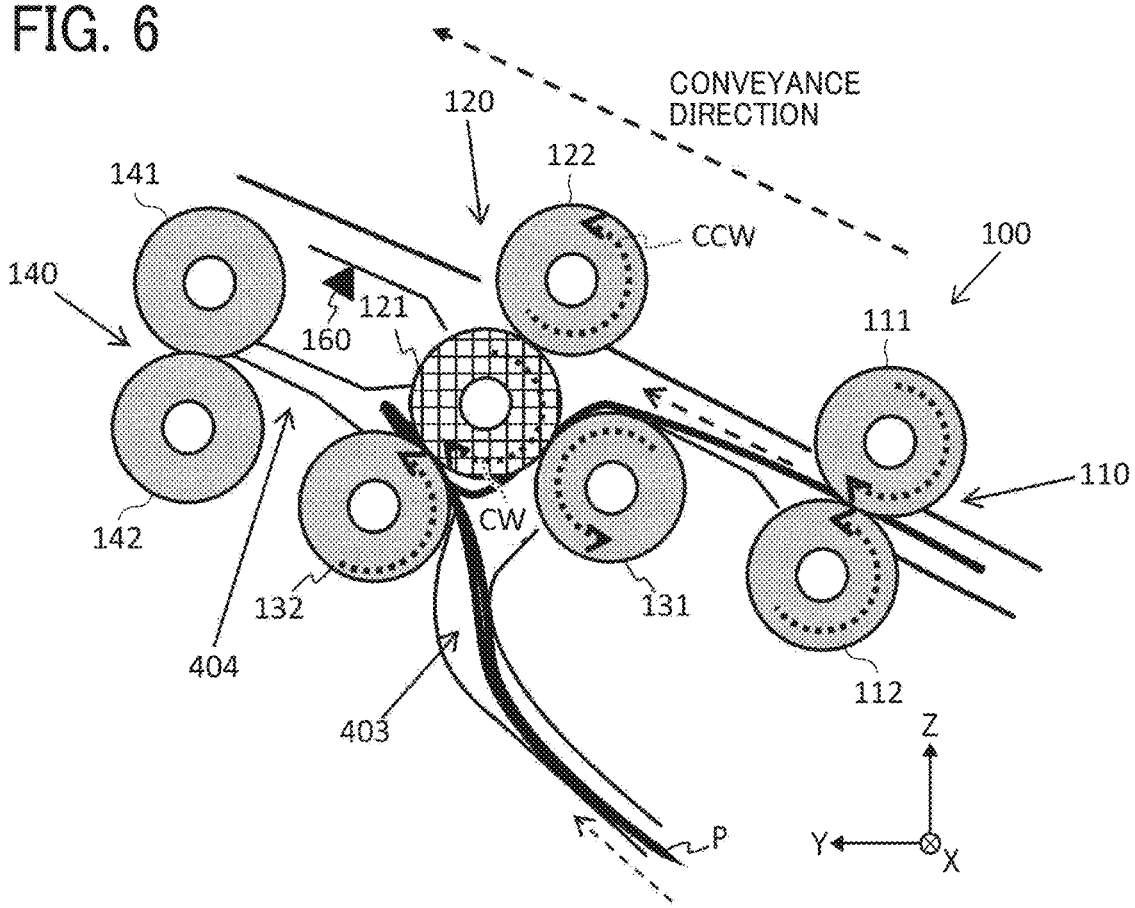
FIG. 6 is a schematic diagram illustrating the folding operation of the sheet processing unit illustrated in FIG. 3.

As illustrated in FIG. 6, the bent portion of the sheet P is nipped between the second conveying drive roller 121 and the second folding roller 132 and is conveyed toward the second folding roller section 140.

Figure 7:
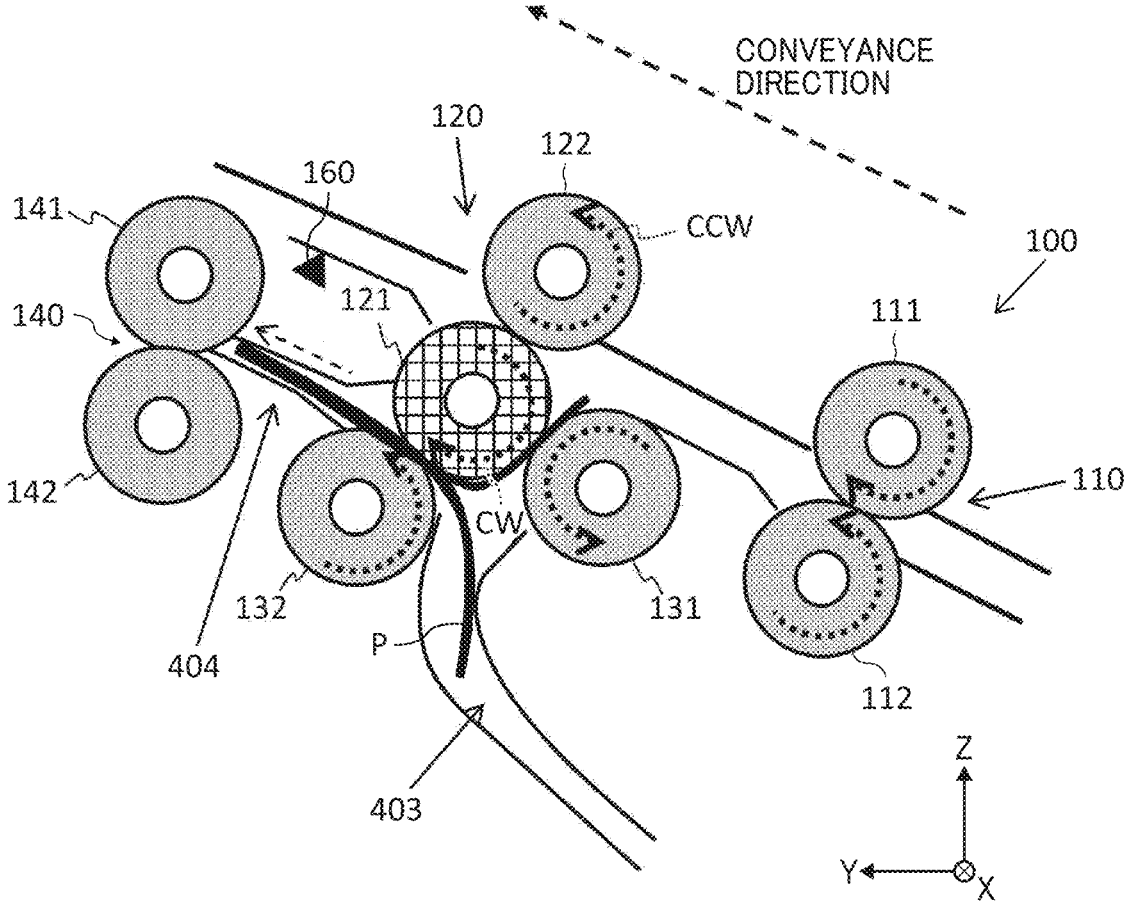
FIG. 7 is a schematic diagram illustrating the folding operation of the sheet processing unit illustrated in FIG. 3.

As illustrated in FIG. 7, the sheet P on which the crease is formed by the second conveying drive roller 121 and the second folding roller 132 is discharged to the fourth conveyance path 404.

First Embodiment

Figure 8:
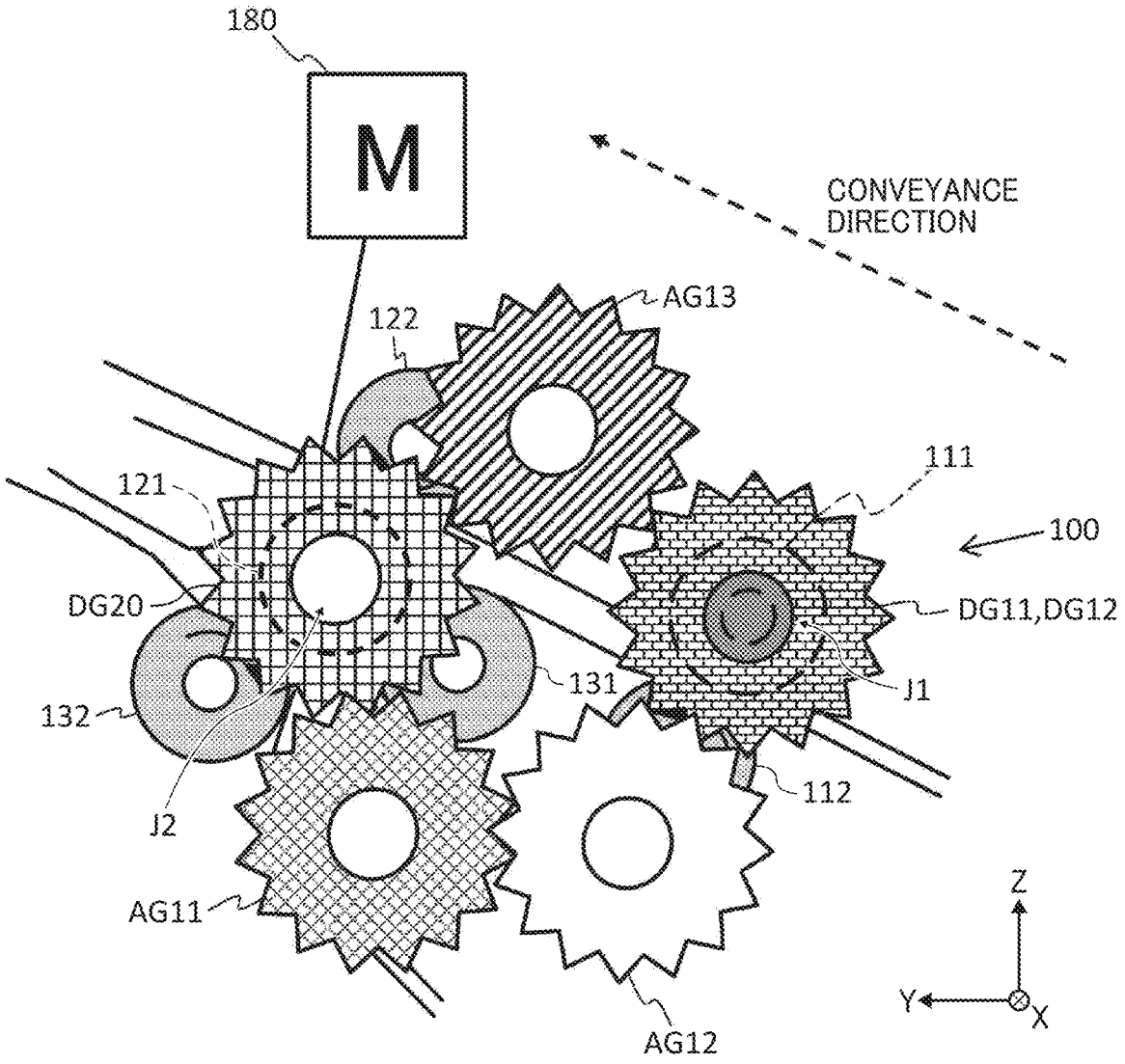
FIG. 8 is a schematic diagram illustrating a drive transmission system of a sheet processing unit according to a first embodiment.
Figure 9:
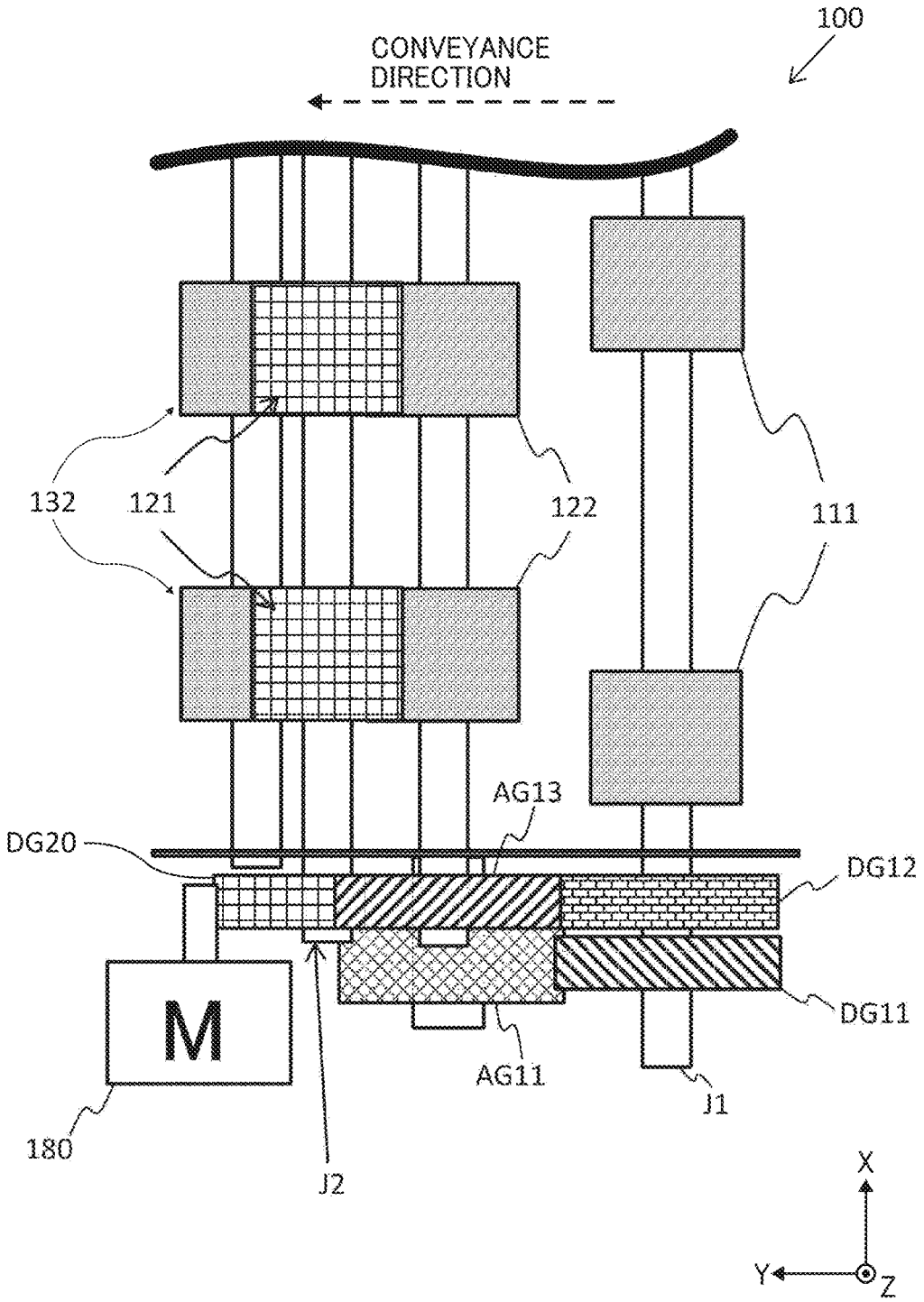
FIG. 9 is a schematic diagram illustrating the drive transmission system of the sheet processing unit according to the first embodiment.
Figure 10:
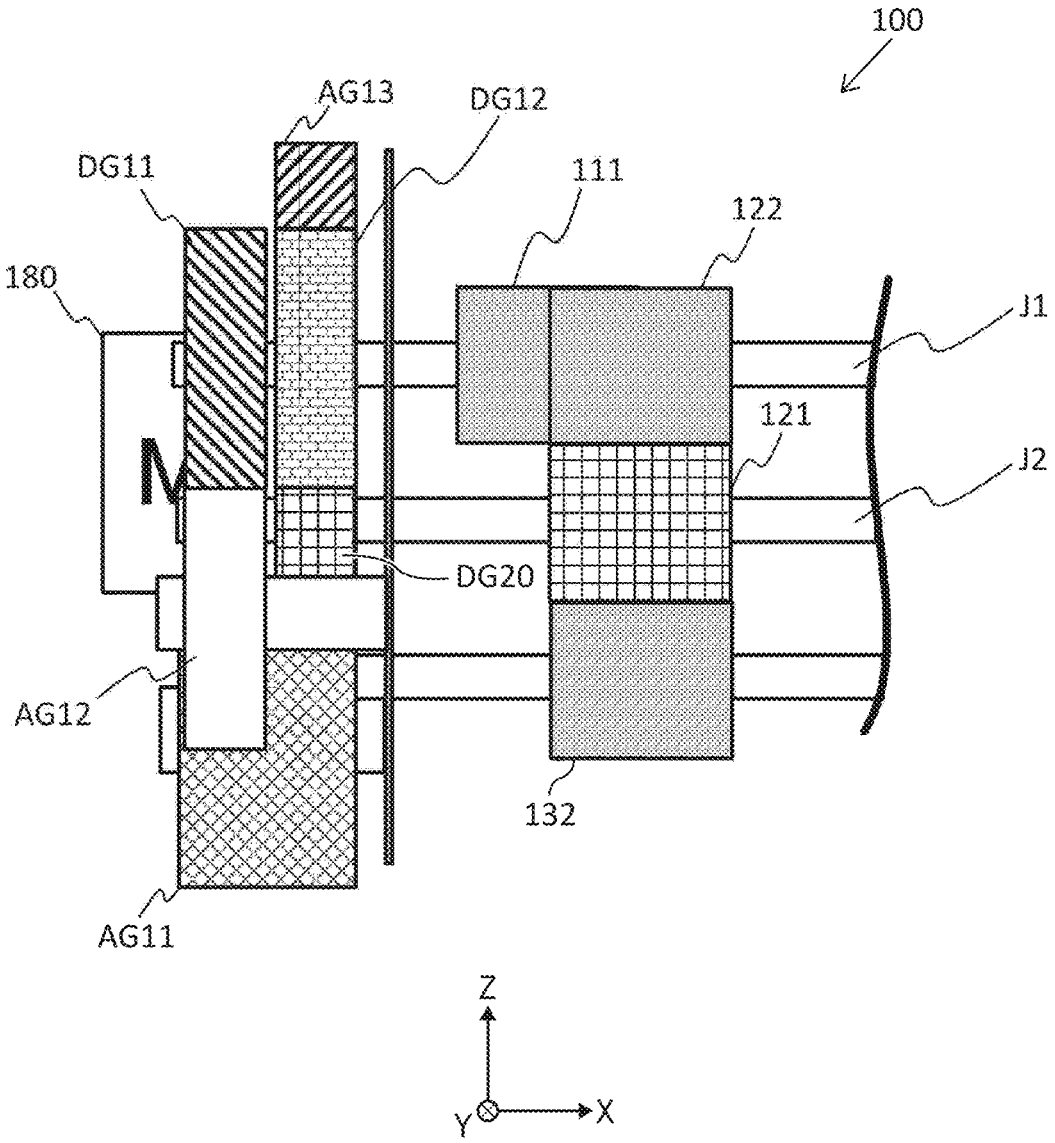
FIG. 10 is a schematic diagram illustrating the drive transmission system of the sheet processing unit according to the first embodiment.

Next, a description is given of the sheet processing unit 100 according to a first embodiment of the present disclosure. FIGS. 8 to 10 are explanatory diagrams illustrating a configuration of a drive system of the conveyance roller pairs of the sheet processing unit 100. As illustrated in FIG. 8, the drive system of the sheet processing unit 100 mainly includes the drive motor 180 (serving as the driving force supply source) and a second-conveying-roller-pair drive gear DG20. The second-conveying-roller-pair drive gear DG20 is driven by the drive motor 180 and transmits the driving force. Note that in FIGS. 9 and 10, for convenience of explanation, the first folding roller 131 and the first conveying driven roller 112 are omitted.

The second-conveying-roller-pair drive gear DG20 is attached to a second conveying roller drive shaft J2 as a rotation shaft of the second conveying drive roller 121. Accordingly, the rotation direction of the second conveying drive roller 121 follows the rotation direction of the drive motor 180 via the second-conveying-roller-pair drive gear DG20.

The drive transmission system of the sheet processing unit 100 includes a plurality of gears that are combined so as to be rotated by the rotation of the second-conveying-roller-pair drive gear DG20. As illustrated in FIG. 8, the drive transmission system includes a first transmission gear AG11 and a third transmission gear AG13. The first transmission gear AG11 is meshed with the second-conveying-roller-pair drive gear DG20. The third transmission gear AG13 is similarly meshed with the second-conveying-roller-pair drive gear DG20. Further, the drive transmission system includes a second transmission gear AG12 that is meshed with the first transmission gear AG11. The drive transmission system includes a first-conveying-roller-pair drive first gear DG11 and a first-conveying-roller-pair drive second gear DG12. The first-conveying-roller-pair drive first gear DG11 is meshed with the second transmission gear AG12. The conveying roller pair drive second gear DG12 is meshed with the third transmission gear AG13.

The first-conveying-roller-pair drive first gear DG11 and the first-conveying-roller-pair drive second gear DG12 are attached to a first conveying roller drive shaft J1 that is the rotation shaft of the first conveying drive roller 111.

Figure 11:
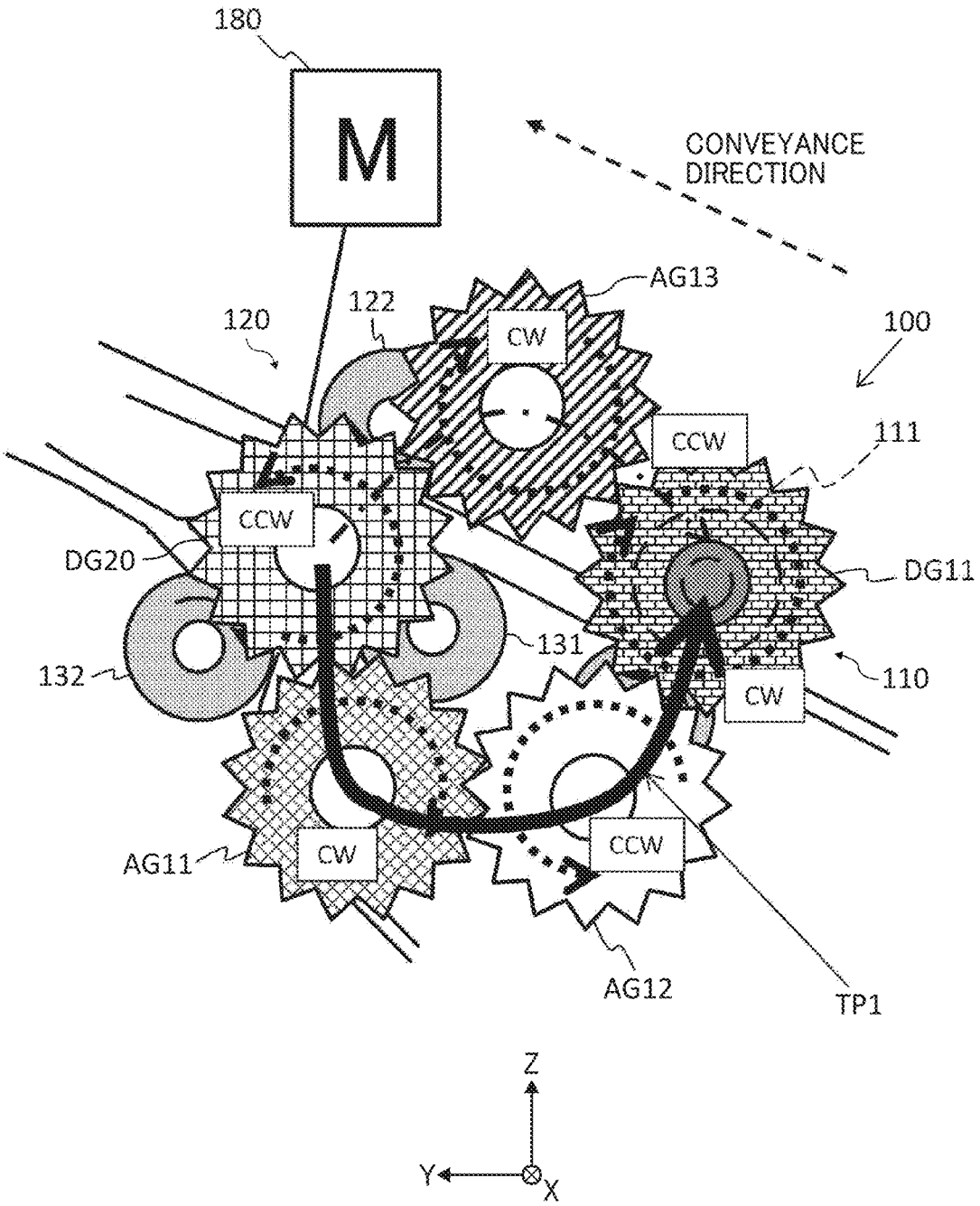
FIG. 11 is a schematic diagram illustrating a first drive transmission path of the drive transmission system according to the first embodiment.
Figure 12:
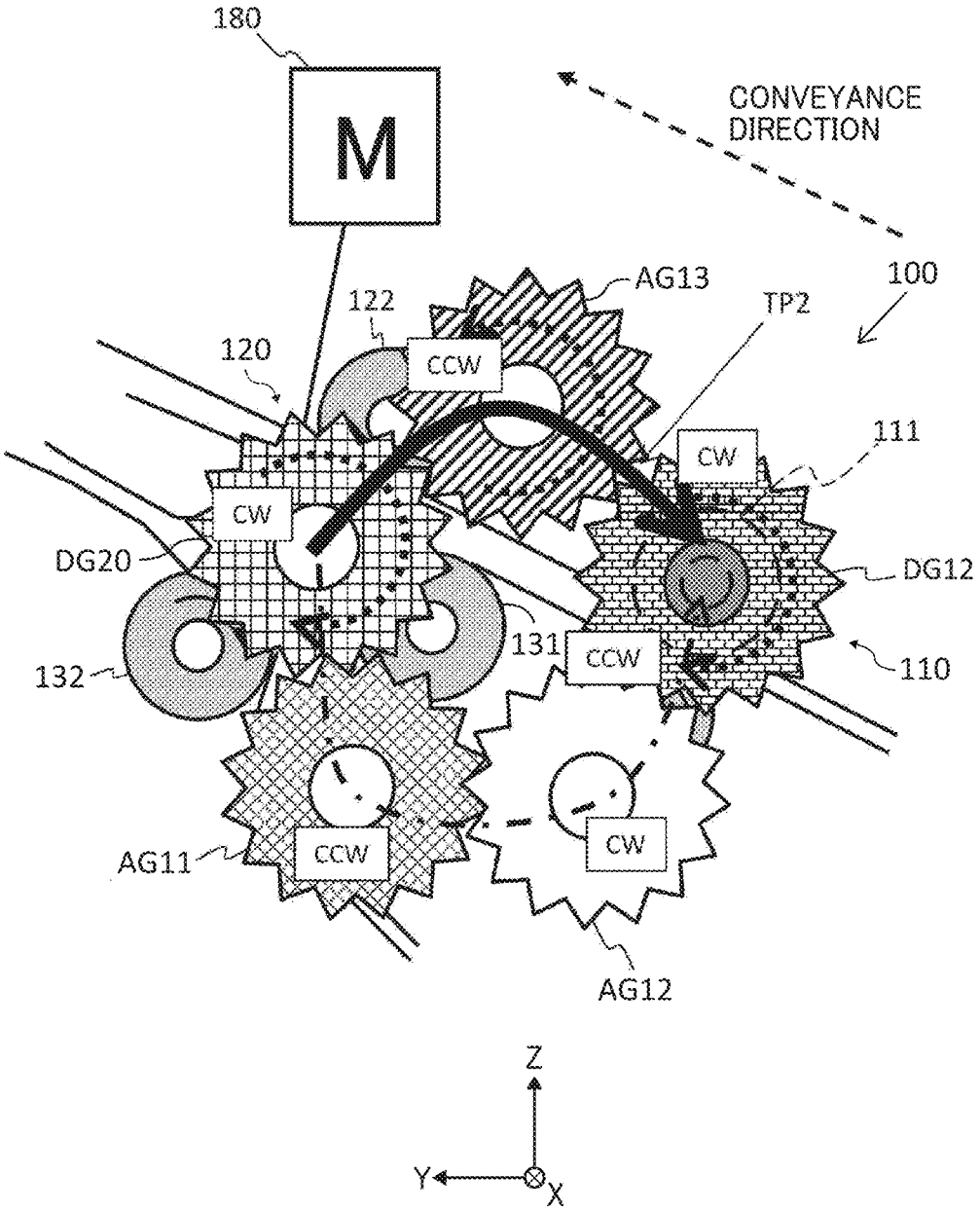
FIG. 12 is a schematic diagram illustrating a second drive transmission path of the drive transmission system according to the first embodiment.

A one-way clutch is built in each of the first-conveying-roller-pair drive first gear DG11 and the first-conveying-roller-pair drive second gear DG12. Each of the one-way clutches causes the first-conveying-roller-pair drive first gear DG11 or the first-conveying-roller-pair drive second gear DG12 to rotate only in the CW direction to transmit the driving force to the first conveying roller drive shaft J1 and causes the first-conveying-roller-pair drive first gear DG11 or the first-conveying-roller-pair drive second gear DG12 so as not to rotate in the CCW direction, thus cutting off the driving force to the first conveying roller drive shaft J1. A description is given of the drive transmission system having the above-described configurations with reference to FIGS. 11 and 12. FIG. 11 illustrates an example in which the sheet P is conveyed in the conveyance direction and each roller is rotated forward. FIG. 12 illustrates an example in which the second conveyor 120 is rotated in reverse so that the sheet P is folded.

As illustrated in FIG. 11, when the second-conveying-roller-pair drive gear DG20 rotates in the CCW direction due to the rotation of the drive motor 180, the first transmission gear AG11 rotates in the CW direction and the second transmission gear AG12 rotates in the CCW direction. At this time, the second conveyor 120 rotates forward. The driving force for rotating the first-conveying-roller-pair drive first gear DG11 in the CW direction is transmitted from the second transmission gear AG12 to the first-conveying-roller-pair drive first gear DG11. Since the one-way clutch built in the first-conveying-roller-pair drive first gear DG11 receives the driving force in the CW direction, the driving force for rotating the first conveying roller drive shaft J1 in the CW direction is transmitted to the first conveying roller drive shaft J1.

When the second-conveying-roller-pair drive gear DG20 rotates in the CCW direction due to the rotation of the drive motor 180, the third transmission gear AG13 rotates in the CW direction, and the driving force for rotating the first-conveying-roller-pair drive second gear DG12 in the CCW direction is transmitted to the first-conveying-roller-pair drive second gear DG12. Since the one-way clutch built in the first-conveying-roller-pair drive second gear DG12 cuts off the driving force in the CCW direction, the driving force for rotating the first conveying roller drive shaft J1 in the CCW direction is not transmitted to the first conveying roller drive shaft J1.

Accordingly, as illustrated in FIG. 11, when the second-conveying-roller-pair drive gear DG20 is rotated in the CCW direction by the drive motor 180, the driving force transmitted by a first drive transmission path TP1 serving as a first drive transmission mechanism rotates the first conveying drive roller 111 in the CW direction. As a result, as illustrated in FIG. 3, the first conveyor 110 and the second conveyor 120 convey the sheet P along the conveyance direction.

As illustrated in FIG. 12, when the second-conveying-roller-pair drive gear DG20 is rotated in the CW direction by the drive motor 180, the second conveyor 120 is rotated in reverse. When the first transmission gear AG11 rotates in the CCW direction, the second transmission gear AG12 rotates in the CW direction. Thus, the driving force is transmitted to the first-conveying-roller-pair drive first gear DG11 to rotate in the CCW direction. However, since the one-way clutch built in the first-conveying-roller-pair drive first gear DG11 cuts off the driving force in the CCW direction, the driving force for rotating the first conveying roller drive shaft J1 in the CCW direction is not transmitted to the first conveying roller drive shaft J1. Accordingly, since the first conveying roller drive shaft J1 does not rotate in the CCW direction, the first conveying drive roller 111 does not also rotate in the CCW direction. Note that, in FIG. 12, for convenience of explanation, the first-conveying-roller-pair drive first gear DG11 is omitted.

When the second-conveying-roller-pair drive gear DG20 rotates in the CW direction due to the rotation of the drive motor 180, the third transmission gear AG13 rotates in the CCW direction, and the driving force for rotating the first-conveying-roller-pair drive second gear DG12 in the CW direction is transmitted from the third transmission gear AG13 to the first-conveying-roller-pair drive second gear DG12. Since the one-way clutch built in the first-conveying-roller-pair drive second gear DG12 transmits the driving force in the CW direction, the driving force for rotating the first conveying roller drive shaft J1 in the CW direction is transmitted to the first conveying roller drive shaft J1.

Accordingly, as illustrated in FIG. 12, when the second-conveying-roller-pair drive gear DG20 is rotated in the CW direction by the drive motor 180, the driving force transmitted by a second drive transmission path TP2 serving as a second drive transmission mechanism rotates the first conveying drive roller 111 in the CW direction. As illustrated in FIG. 4, the first conveyor 110 conveys the sheet P in the conveyance direction, and the second conveyor 120 conveys the sheet P in the direction opposite to the conveyance direction (i.e., the upstream side in the conveyance direction).

As described above, the sheet processing unit 100 according to the present embodiment has a plurality of drive transmission paths (i.e., the first drive transmission path TP1 and the second drive transmission path TP2) on which the rotation direction of the first conveying drive roller 111 is only in the CW direction regardless of whether the rotation direction of the rotation shaft of the drive motor 180 is the CW direction or the CCW direction.

When the rotation direction of the rotation shaft of the drive motor 180 is switched, the rotation direction of the second conveying drive roller 121 is switched. On the other hand, the rotation direction of the first conveying drive roller 111 may not be switched so that the first conveying drive roller 111 rotates only in a certain direction. Thus, the operations of the first conveyor 110 and the second conveyor 120 are controlled only by the drive force from the drive motor 180 serving as a single driving force supply source. That is, as described with reference to FIGS. 3 and 4, by switching the rotation direction of the drive motor 180 at a predetermined timing, the conveyance direction of the downstream portion of the sheet P can be switched to the direction opposite to the conveyance direction (i.e., the upstream side in the conveyance direction). The upstream portion of the sheet P can be conveyed continuously in the conveyance direction. As a result, as illustrated in FIG. 4, the sheet P is inserted into the nip between the second conveying drive roller 121 and the first folding roller 131 while a bend is formed on the sheet P at a predetermined position, thus allowing a crease to be accurately formed at a predetermined position.

The rotational drive of the first folding roller section 130 after formation of the bend, and the rotational drive of the second folding roller section 140 and the discharge roller section 150 are also performed by the driving force of the drive motor 180. Such a configuration can perform the folding process on the sheet P with a reduced size of the sheet processing unit 100.

Second Embodiment

Figure 13:
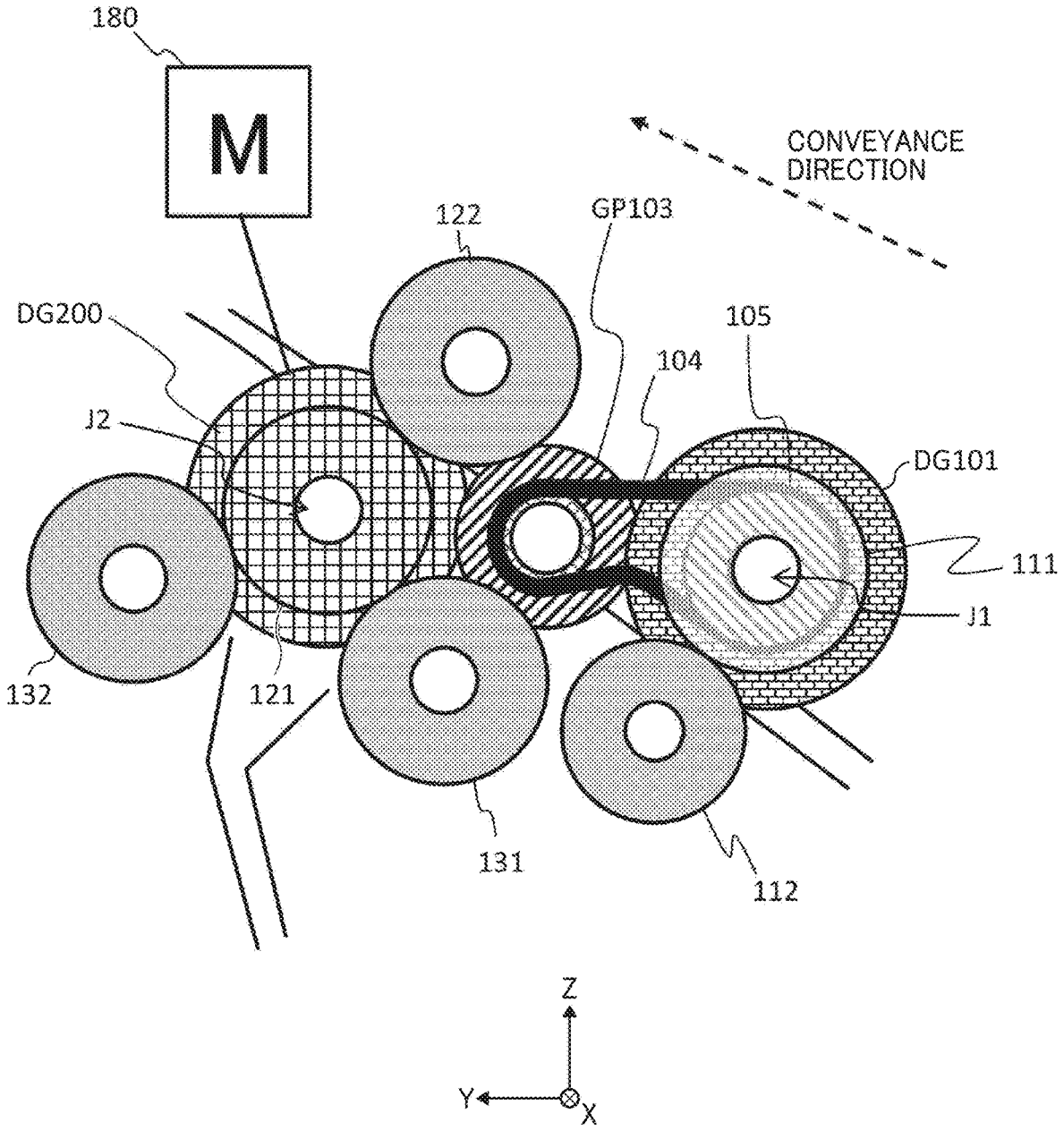
FIG. 13 is a schematic diagram illustrating a drive transmission system of a sheet processing unit according to a second embodiment.
Figure 14:
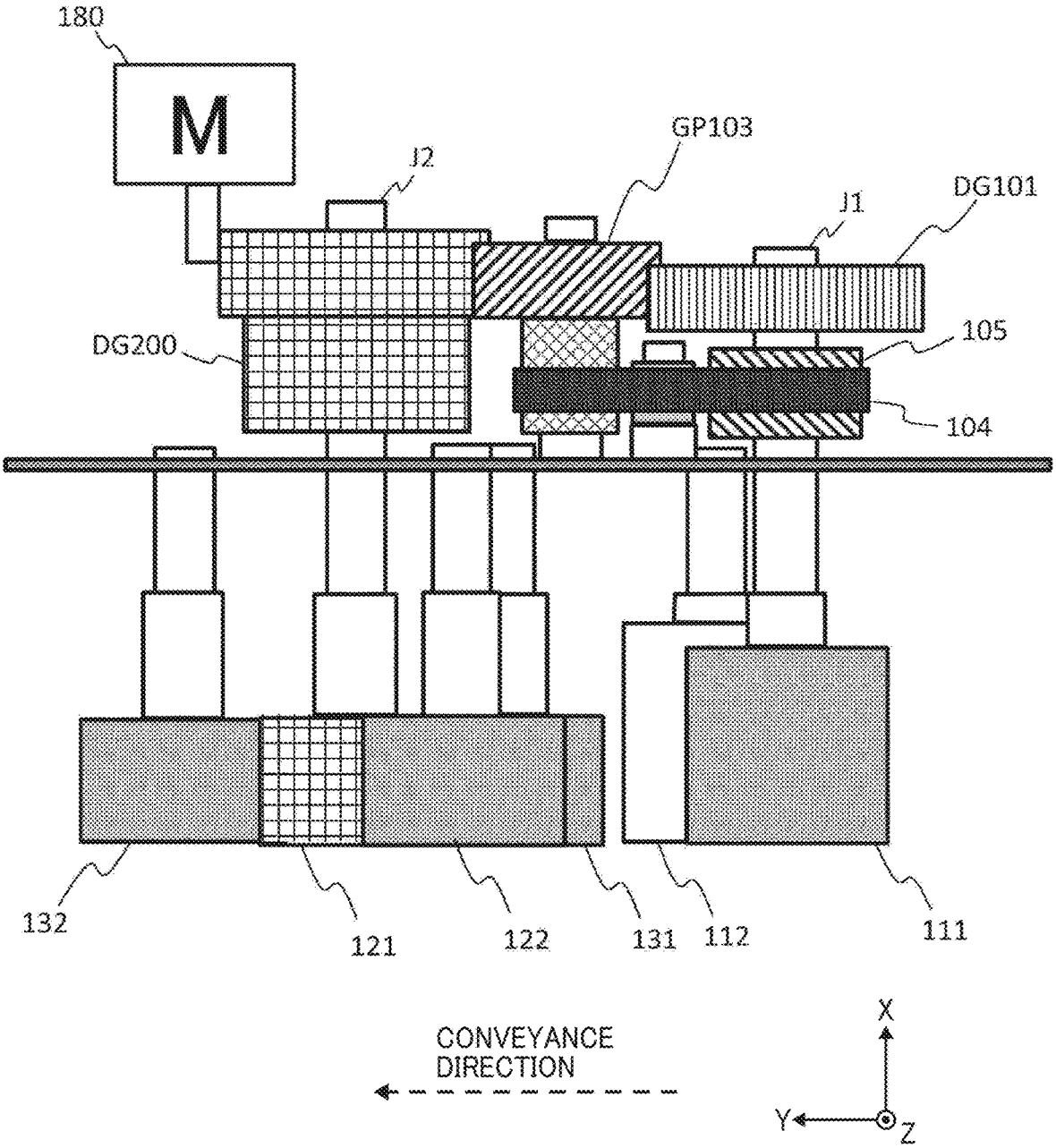
FIG. 14 is a schematic diagram illustrating the drive transmission system of the sheet processing unit according to the second embodiment.

Next, a description is given of a sheet processing unit 100 according to a second embodiment of the present disclosure. FIGS. 13 to 14 are diagrams illustrating a configuration of a drive transmission system of conveying roller pairs in the sheet processing unit 100 according to the second embodiment. As illustrated in FIGS. 13 and 14, the drive system of the sheet processing unit 100 mainly includes the drive motor 180 (serving as the driving force supply source) and a second-conveying-roller-pair drive gear DG200. The second-conveying-roller-pair drive gear DG200 is driven by the drive motor 180 and transmits the driving force.

The second-conveying-roller-pair drive gear DG200 is attached to the second conveying roller drive shaft J2 as the rotation shaft of the second conveying drive roller 121. Accordingly, the rotation direction of the second conveying drive roller 121 is the same as the rotation direction of the second-conveying-roller-pair drive gear DG200 and follows the rotation direction of the drive motor 180. When the drive motor 180 is rotated forward, the second conveying drive roller 121 and the second-conveying-roller-pair drive gear DG200 are also rotated forward. When the drive motor 180 is rotated in reverse, the second conveying drive roller 121 and the second-conveying-roller-pair drive gear DG200 are also rotated in reverse.

A drive transmission idler gear pulley GP103 meshes with the second-conveying-roller-pair drive gear DG200. The drive transmission idler gear pulley GP103 rotates as the driving force is transmitted to the drive transmission idler gear pulley GP103 by the rotation of the second-conveying-roller-pair drive gear DG200.

As illustrated in FIG. 14, the drive transmission idler gear pulley GP103 is roughly classified into a large-diameter portion and a small-diameter portion. The large-diameter portion meshes with the second-conveying-roller-pair drive gear DG200 and a first-conveying-roller-pair drive gear DG101. A first timing belt 104 is wound around the small-diameter portion.

The first timing belt 104 is also wound around a first-conveying-roller-pair drive pulley 105 serving as a transmission mechanism of the first conveying roller drive shaft J1 that is the drive shaft of the first conveying drive roller 111. Accordingly, when the drive transmission idler gear pulley GP103 rotates, the driving force thereof also rotate the first-conveying-roller-pair drive pulley 105 via the first timing belt 104.

The first-conveying-roller-pair drive pulley 105 is attached to the first conveying roller drive shaft J1 serving as the rotation shaft of the first conveying drive roller 111. The first-conveying-roller-pair drive gear DG101 is also attached to the first conveying roller drive shaft J1. The first-conveying-roller-pair drive gear DG101 also meshes with the large-diameter portion of the second-conveying-roller-pair drive gear DG200.

Accordingly, in the sheet processing unit 100 according to the present embodiment, the driving force supplied from the drive motor 180 drives the second conveying drive roller 121 and also drives the first conveying drive roller 111 by transmitting the driving force to the first conveying drive roller 111.

Figure 15:
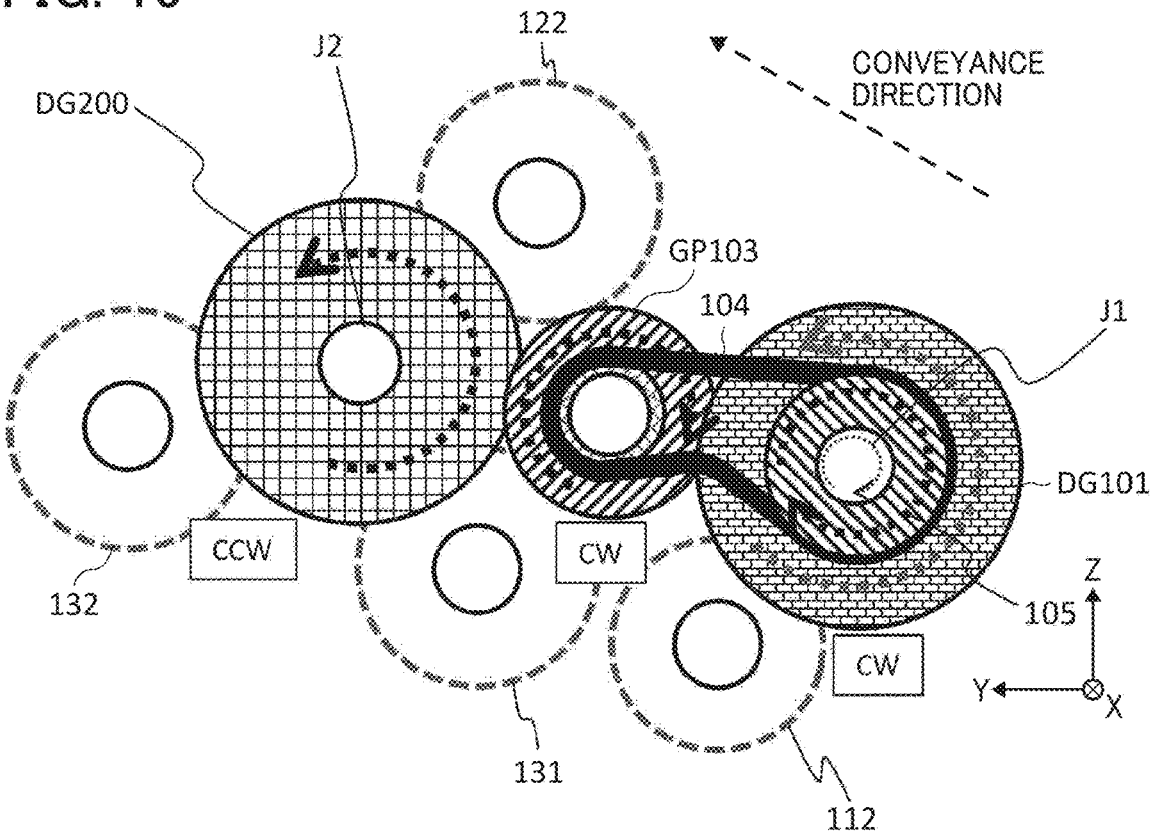
FIG. 15 is a schematic diagram illustrating a second drive transmission path of the drive transmission system according to the second embodiment.

The driving force transmission path to the first conveying drive roller 111 has a configuration in which two paths coexist. In the first path serving as the first drive transmission mechanism, as illustrated in FIG. 15, the driving force transmitted from the second-conveying-roller-pair drive gear DG200 via the large diameter portion of the drive transmission idler gear pulley GP103 is transmitted to the small diameter portion of the drive transmission idler gear pulley GP103, the first timing belt 104, and the first-conveying-roller-pair drive pulley 105. In the second path serving as the second drive transmission mechanism, as illustrated in FIG. 16, the driving force transmitted from the second-conveying-roller-pair drive gear DG200 via the large diameter portion of the drive transmission idler gear pulley GP103 is transmitted via the first-conveying-roller-pair drive gear DG101.

A one-way clutch is built in each of the first-conveying-roller-pair drive gear DG101 and the first-conveying-roller-pair drive pulley 105. The one-way clutch transmits the driving force in only one direction and cut offs the driving force in the other direction so that corresponding one of the first-conveying-roller-pair drive gear DG101 and the first-conveying-roller-pair drive pulley 105 rotates forward (i.e., the rotation in the CW direction illustrated in FIGS. 15 and 16) but does not rotate in reverse.

Figure 16:
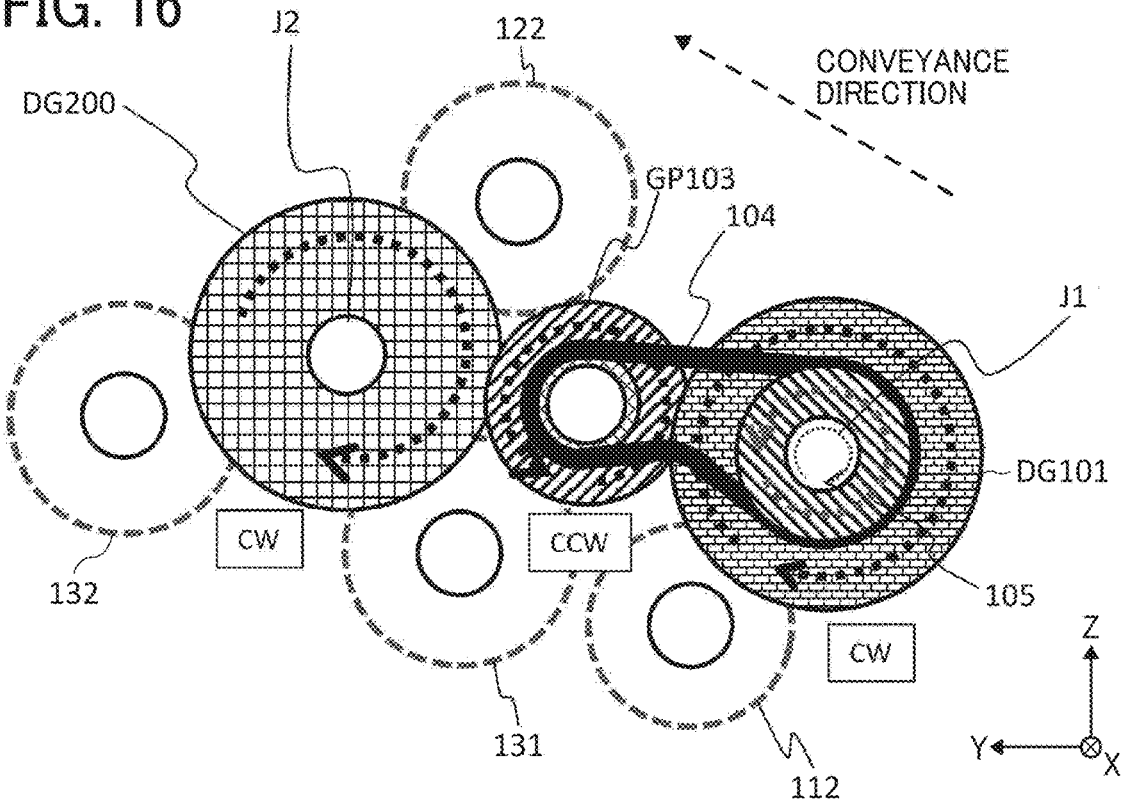
FIG. 16 is a schematic diagram illustrating a first drive transmission path of the drive transmission system according to the second embodiment.

A description is given of the driving system having the above-described configurations with reference to FIGS. 15 and 16. As illustrated in FIG. 15, when the second-conveying-roller-pair drive gear DG200 rotates in the CCW direction due to the rotation of the drive motor 180, the drive transmission idler gear pulley GP103 rotates in the CW direction. A driving force in the CCW direction is transmitted to the first-conveying-roller-pair drive gear DG101 that meshes with the large diameter portion of the drive transmission idler gear pulley GP103. However, the built-in one-way clutch cuts off the driving force.

At this time, the small diameter portion of the drive transmission idler gear pulley GP103 rotates in the CW direction, and the rotation is transmitted to the first-conveying-roller-pair drive pulley 105 via the first timing belt 104. The first-conveying-roller-pair drive pulley 105 rotates in the CW direction, which is the same direction as the rotation direction of the drive transmission idler gear pulley GP103. The one-way clutch built in the first-conveying-roller-pair drive pulley 105 transmits the driving force for rotating the first-conveying-roller-pair drive pulley 105 in the CW direction. Accordingly, when the first-conveying-roller-pair drive pulley 105 rotates in the CW direction, the first conveying roller drive shaft J1 also rotates in the CW direction, and first conveying drive roller 111 rotates in the CW direction.

That is, in the second embodiment, the path through which the driving force is transmitted from the second-conveying-roller-pair drive gear DG200 to the first-conveying-roller-pair drive pulley 105 via the small diameter portion of the drive transmission idler gear pulley GP103 corresponds the first drive transmission path TP1 illustrated in FIG. 11.

As illustrated in FIG. 16, when the second-conveying-roller-pair drive gear DG200 rotates in the CW direction due to the rotation of the drive motor 180, the drive transmission idler gear pulley GP103 rotates in the CCW direction. The first-conveying-roller-pair drive gear DG101 that meshes with the large diameter portion of the drive transmission idler gear pulley GP103 rotates in the CW direction. Since the first-conveying-roller-pair drive gear DG101 has a built-in one-way clutch so as to rotate in the CW direction, the driving force for rotating the first conveying roller drive shaft J1 in the CW direction is transmitted to the first conveying roller drive shaft J1, and the first conveying roller pair rotates forward.

At this time, the rotation of the small diameter portion of the drive transmission idler gear pulley GP103 is also transmitted to the first-conveying-roller-pair drive pulley 105 via the first timing belt 104. The first-conveying-roller-pair drive pulley 105 rotates in the same direction (i.e., CCW direction) as the rotation direction of the drive transmission idler gear pulley GP103. In this case, the driving force for rotating the first-conveying-roller-pair drive pulley 105 in the CCW direction is transmitted to the first-conveying-roller-pair drive pulley 105. However, this driving force is cut off by the one-way clutch. As a result, the rotation of the first-conveying-roller-pair drive pulley 105 is not transmitted to the first conveying drive roller 111.

When the second conveying drive roller 121 rotates in the CW direction due to the rotation of the drive motor 180, the driving force for rotating the first-conveying-roller-pair drive gear DG101 in the CW direction is transmitted from the second-conveying-roller-pair drive gear DG200 to the first-conveying-roller-pair drive gear DG101 via the large diameter portion of the drive transmission idler gear pulley GP103. Accordingly, the first conveying roller drive shaft J1 rotates in the CW direction.

That is, in the second embodiment, the path through which the driving force is transmitted from the second-conveying-roller-pair drive gear DG200 to the first-conveying-roller-pair drive gear DG101 via the large diameter portion of the drive transmission idler gear pulley GP103 corresponds the second drive transmission path TP2 illustrated in FIG. 12.

As described above, when the rotation direction of the rotation shaft of the drive motor 180 is switched, the rotation direction of the second conveying drive roller 121 is switched. On the other hand, the rotation direction of the first conveying drive roller 111 is not switched and the first conveying drive roller 111 rotates only in a certain direction. Such a configuration, as described above, allows a plurality of conveying roller pairs to perform the folding process by the driving force of the drive motor 180 serving as the single driving force supply source at a predetermined timing. When the rotation direction of the drive motor 180 is switched. an upstream portion of the sheet P can be maintained as being conveyed in the conveyance direction while the direction of a downstream portion of the sheet P is switched to the upstream direction. As a result, as illustrated in FIG. 4, the sheet P is inserted into the nip between the second conveying drive roller 121 and the first folding roller 131 while a bend is formed on the sheet P at a predetermined position, thus allowing a crease to be accurately formed at a predetermined position.

After the bend is formed, the rotational drive of the first folding roller section 130 and the rotational drive of the second folding roller section 140 and the discharge roller section 150 are also performed by the driving force of the drive motor 180. Such a configuration can perform the folding process on the sheet P with a reduced size of the sheet processing unit 100.

Referring to FIGS. 17A to 23B, a description is given of the flow of a folding operation that can be performed in the configuration of the sheet processing unit 100 according to the second embodiment. The sheet processing unit 100 according to the present embodiment is disposed on the backward of the conveyance path of the sheet P. To facilitate the explanation, a state in which the configuration illustrated in FIG. 13 is viewed from the opposite side is illustrated in each of FIGS. 17A to 23B. Accordingly, the rotation direction (CW or CCW direction) used in the description of FIGS. 17A to 23B is opposite to the rotation direction (CW or CCW direction) illustrated in FIGS. 15 and 16.

In FIGS. 17A to 23B, FIGS. 17A, 18A, 19A, 20A, 21A, 22A, and 23A illustrate the arrangement of the drive system that transmits the driving force to the conveying roller pairs to rotate in predetermined directions, and the rotation direction of the configuration of each drive system. FIGS. 17B, 18B, 19B, 20B, 21B, 22B, and 23B illustrate the arrangement and the rotation directions of the conveying roller pairs.

Figure 17A:
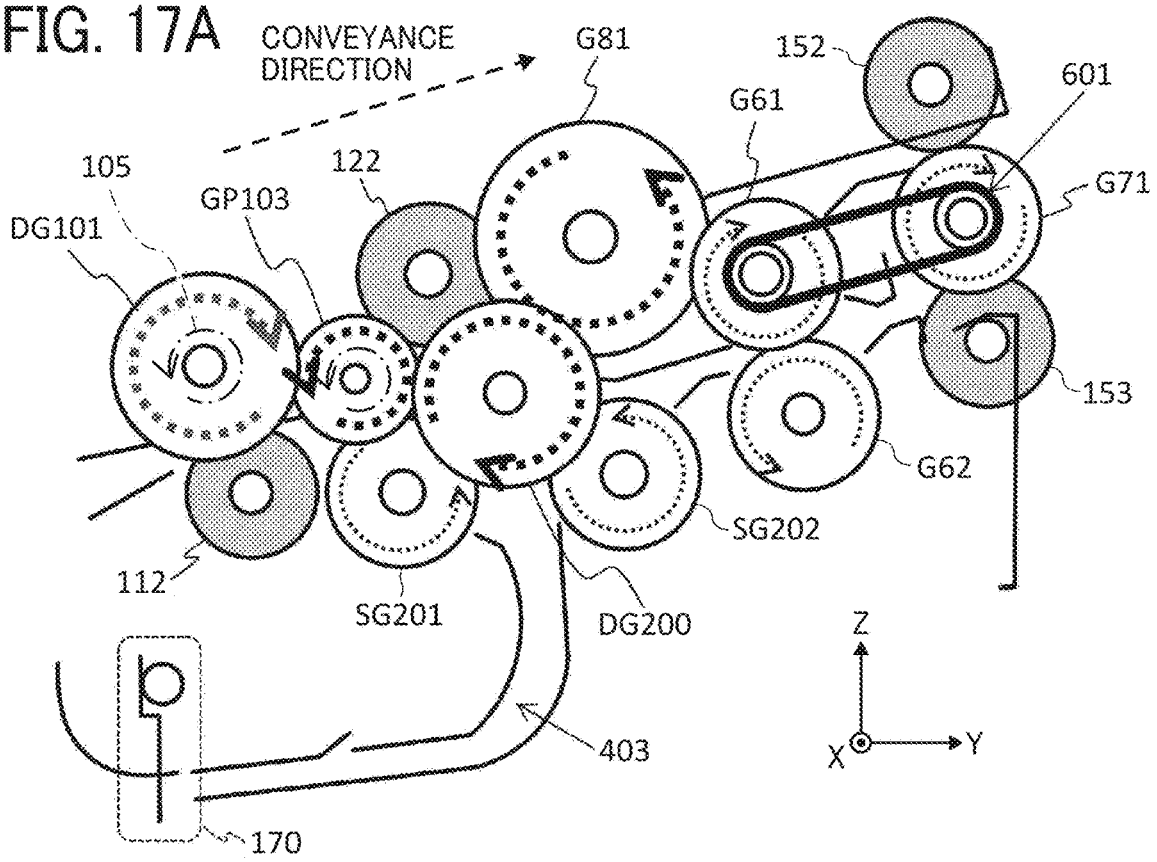
FIG. 17A is a schematic diagram illustrating the drive transmission system in a folding process of the sheet processing unit according to the second embodiment.
Figure 17B:
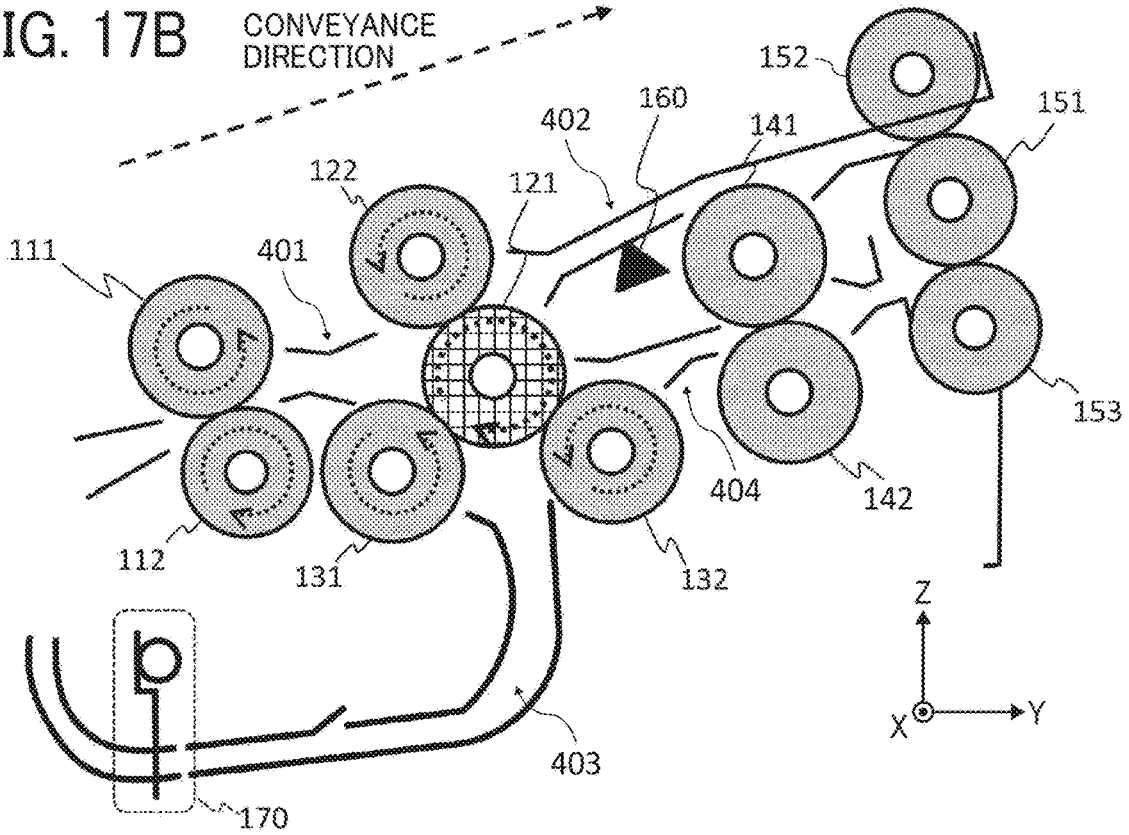
FIG. 17B is a schematic diagram illustrating conveying roller pairs in the folding process of the sheet processing unit according to the second embodiment.

When the second-conveying-roller-pair drive gear DG200 rotates in the CW direction in FIG. 17A, the second conveyor 120 including the second conveying drive roller 121 and the second conveying driven roller 122 rotates forward. When the second-conveying-roller-pair drive gear DG200 rotates in the CW direction, the first-conveying-roller-pair drive gear DG101 also rotates in the CW direction. As illustrated in FIG. 15, the drive transmission to the first conveying drive roller 111 is cut off by the action of the one-way clutch built in the first-conveying-roller-pair drive gear DG101.

On the other hand, when the second-conveying-roller-pair drive gear DG200 rotates in the CW direction, the drive transmission idler gear pulley GP103 rotates in the CCW direction. The rotation of the drive transmission idler gear pulley GP103 is transmitted to the first-conveying-roller-pair drive pulley 105 via the first timing belt 104 that meshes the small diameter portion of the drive transmission idler gear pulley GP103. The first-conveying-roller-pair drive pulley 105 rotates in the CCW direction, and the driving force in the CCW direction is transmitted to the first conveying drive roller 111.

As a result, the driving force is transmitted to the first conveying drive roller 111, and the first conveyor 110 including the first conveying drive roller 111 and the first conveying driven roller 112 also rotates forward. Note that "rotate forward" means the rotation direction of each roller that constitutes the first conveyor 110 and the second conveyor 120 when the sheet P is conveyed in the conveyance direction illustrated in FIGS. 17A and 17B.

A second-conveying-driven-roller first gear SG201, a second-conveying-driven-roller second gear SG202, and a drive transmission idler gear G81 mesh with the small diameter portion (see FIG. 14) of the second-conveying-roller-pair drive gear DG200. The second-conveying-driven-roller first gear SG201, the second-conveying-driven-roller second gear SG202, and the drive transmission idler gear G81 rotate in the direction opposite to the rotation direction of the second-conveying-roller-pair drive gear DG200. Accordingly, as illustrated in FIG. 17A, when the rotation direction of the second-conveying-roller-pair drive gear DG200 is in the CW direction, the second-conveying-driven-roller first gear SG201, the second-conveying-driven-roller second gear SG202, and the drive transmission idler gear G81 rotate in the CCW direction.

The second-conveying-driven-roller first gear SG201 rotates the first folding roller 131. The second-conveying-driven-roller second gear SG202 rotates the second folding roller 132. Accordingly, when the second-conveying-driven-roller first gear SG201 and the second-conveying-driven-roller second gear SG202 rotate in the CCW direction, the first folding roller 131 and the second folding roller 132 also rotate in the CCW direction.

An additional-folding drive gear G61 also meshes with the drive transmission idler gear G81. An additional-folding drive gear G62 meshes with the additional-folding drive gear G61. A second timing belt 601 is wound around the rotation shaft of the additional-folding drive gear G61. The second timing belt 601 is also wound around the rotation shaft of a discharge drive gear G71. With such a configuration, when the drive transmission idler gear G81 rotates, the driving force is transmitted to the additional-folding drive gear G61, the additional-folding driven gear G62, and the discharge drive gear G71, thus rotating each of the gears.

The additional-folding drive roller 141 is disposed on the rotation shaft of the additional-folding drive gear G61. The additional-folding driven roller 142 is disposed on the rotation shaft of the additional-folding driven gear G62. The first discharge roller 151 is disposed on the rotation shaft of the discharge drive gear G71.

Accordingly, when the second-conveying-roller-pair drive gear DG200 rotates in the CW direction, the drive transmission idler gear G81 rotates in the CCW direction, and the additional-folding drive gear G61 and the discharge drive gear G71 rotate in the CW direction. Then, the additional-folding driven gear G62 rotates in the CCW direction, and the discharge drive gear G71 rotates in the CW direction. As a result, the additional-folding drive roller 141 rotates in the CW direction, the additional-folding driven roller 142 rotates in the CCW direction, and the first discharge roller 151 rotates in the CW direction.

Figure 18A:
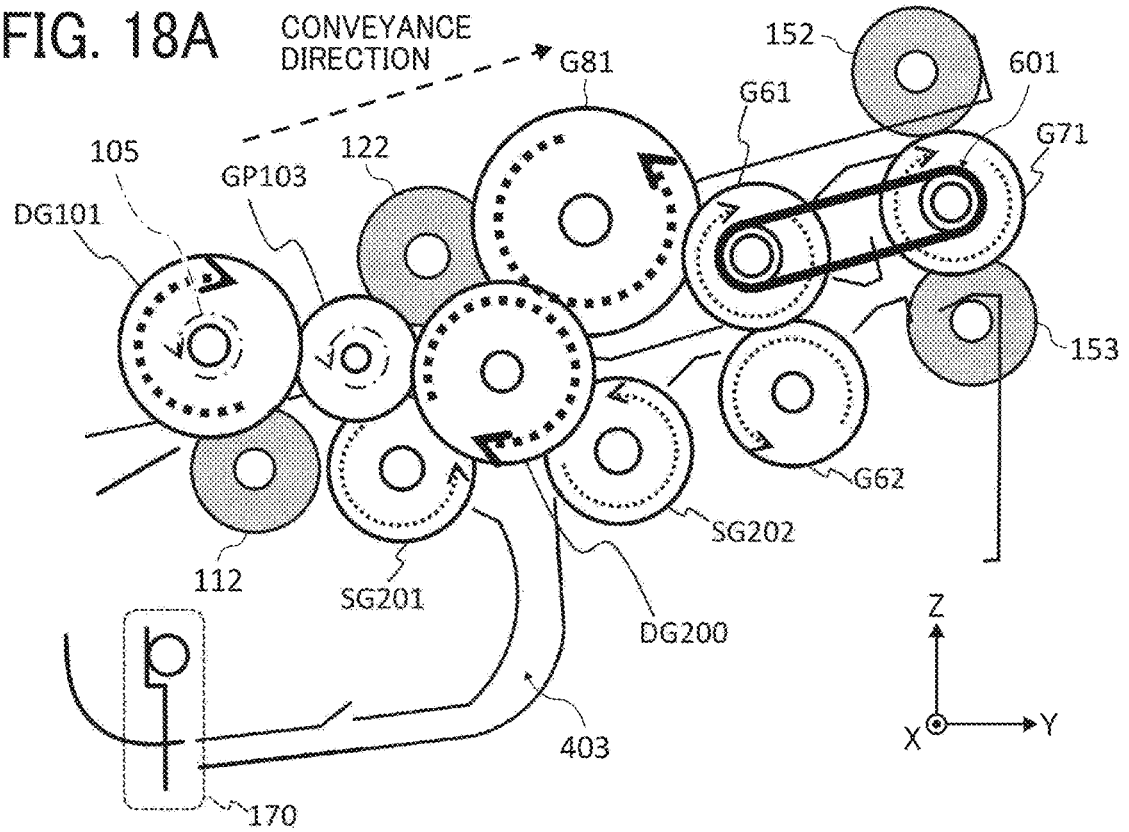
FIG. 18A is a schematic diagram illustrating the drive transmission system in the folding process of the sheet processing unit according to the second embodiment.
Figure 18B:
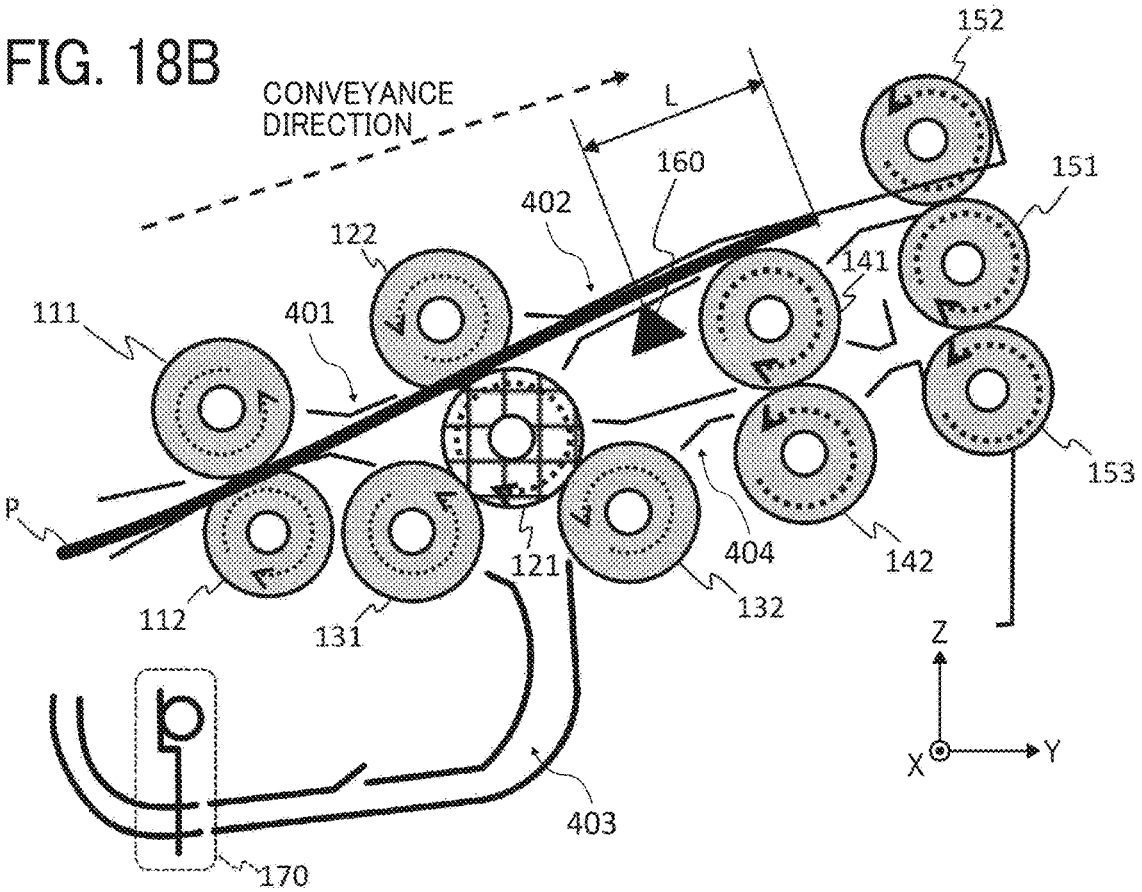
FIG. 18B is a schematic diagram illustrating the conveying roller pairs in the folding process of the sheet processing unit according to the second embodiment.

Subsequently, as illustrated in FIG. 18B, when the sheet P is carried in, the first conveying drive roller 111 and the first conveying driven roller 112 rotate forward by the driving force of the drive motor 180 (see FIG. 15). The second conveying drive roller 121 and the second conveying driven roller 122 also rotate forward. Accordingly, the sheet P is conveyed in the conveyance direction. After the leading end of the sheet P is detected by the first sheet detector 160, the sheet P is continuously conveyed to a designated length L, and the drive motor 180 is rotated in the reverse direction.

Figure 19A:
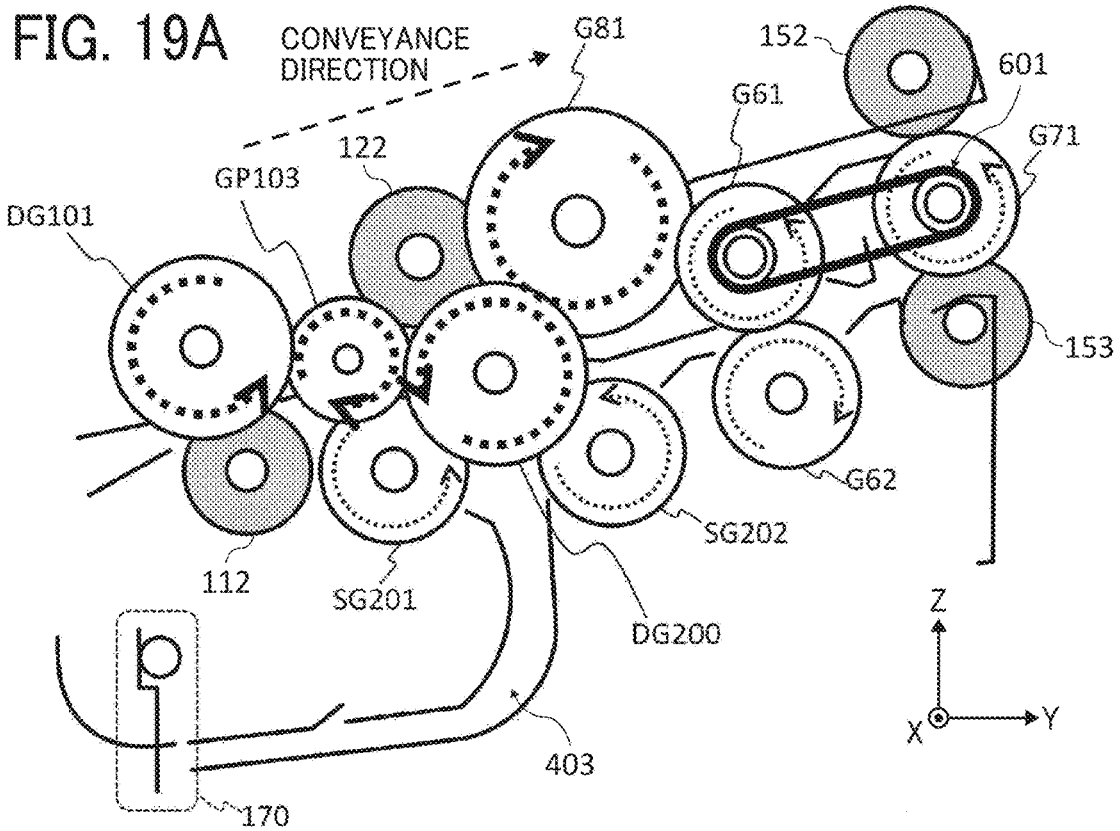
FIG. 19A is a schematic diagram illustrating the drive transmission system in the folding process of the sheet processing unit according to the second embodiment.
Figure 19B:
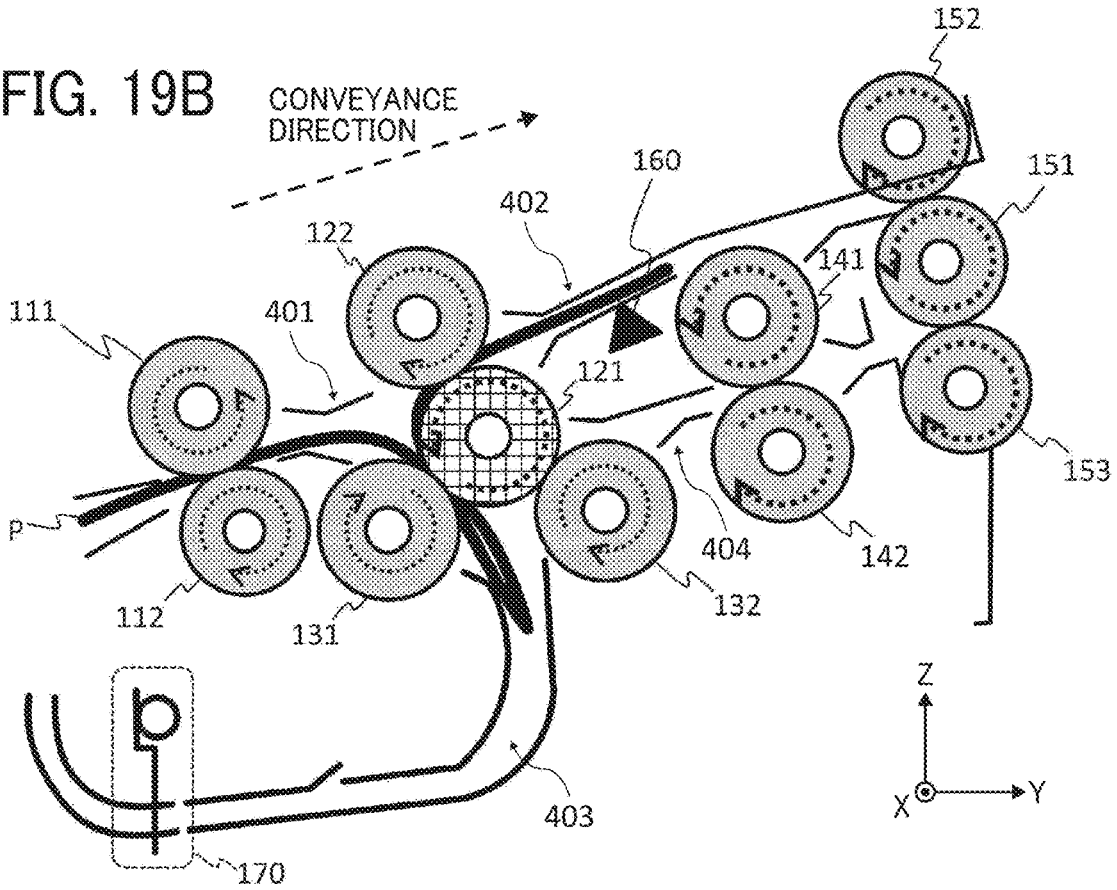
FIG. 19B is a schematic diagram illustrating the conveying roller pairs in the folding process of the sheet processing unit according to the second embodiment.

When the rotation direction of the drive motor 180 is switched, as illustrated in FIG. 19A, the second-conveying-roller-pair drive gear DG200 rotates in the CCW direction in FIG. 19A, and the rotation direction of the second conveyor 120 that includes the second conveying drive roller 121 and the second conveying driven roller 122 is reversed. On the other hand, when the second-conveying-roller-pair drive gear DG200 rotates in the CCW direction, the first-conveying-roller-pair drive gear DG101 also rotates in the CCW direction, so that the driving force in the CCW direction is transmitted to the first conveying drive roller 111. At this time, the first-conveying-roller-pair drive pulley 105 rotates in the CW direction via the first timing belt 104 hung on the small diameter portion of the drive transmission idler gear pulley GP103. The drive transmission to the first conveying drive roller 111 is cut off by the action of the one-way clutch built in the first-conveying-roller-pair drive pulley 105 as illustrated in FIG. 16.

With such a configuration, the first conveyor 110 including the first conveying drive roller 111 and the first conveying driven roller 112 also rotate forward. That is, while the conveyance direction of the downstream portion of the sheet P is switched to the direction opposite to the conveyance direction (i.e., the upstream side in the conveyance direction), the upstream portion of the sheet P can be conveyed continuously in the conveyance direction.

As a result, as illustrated in FIG. 4, the sheet P is inserted into the nip between the second conveying drive roller 121 and the first folding roller 131 while a bend is formed on the sheet P in the vicinity of the nip between the second conveying drive roller 121 and the first folding roller 131 in the first conveyance path 401, thus allowing a crease to be accurately formed at a predetermined position.

The bend of the sheet P is nipped between the second conveying drive roller 121 and the first folding roller 131 each rotating in the direction to convey the sheet P toward the third conveyance path 403, and the first folding process is performed. Thereafter, when the sheet P continues to be conveyed toward the third conveyance path 403 as it is, as illustrated in FIG. 20B, the first crease moves to a position where the first crease contacts the second sheet detector 170 serving as the leading end stopper.

Figure 20A:
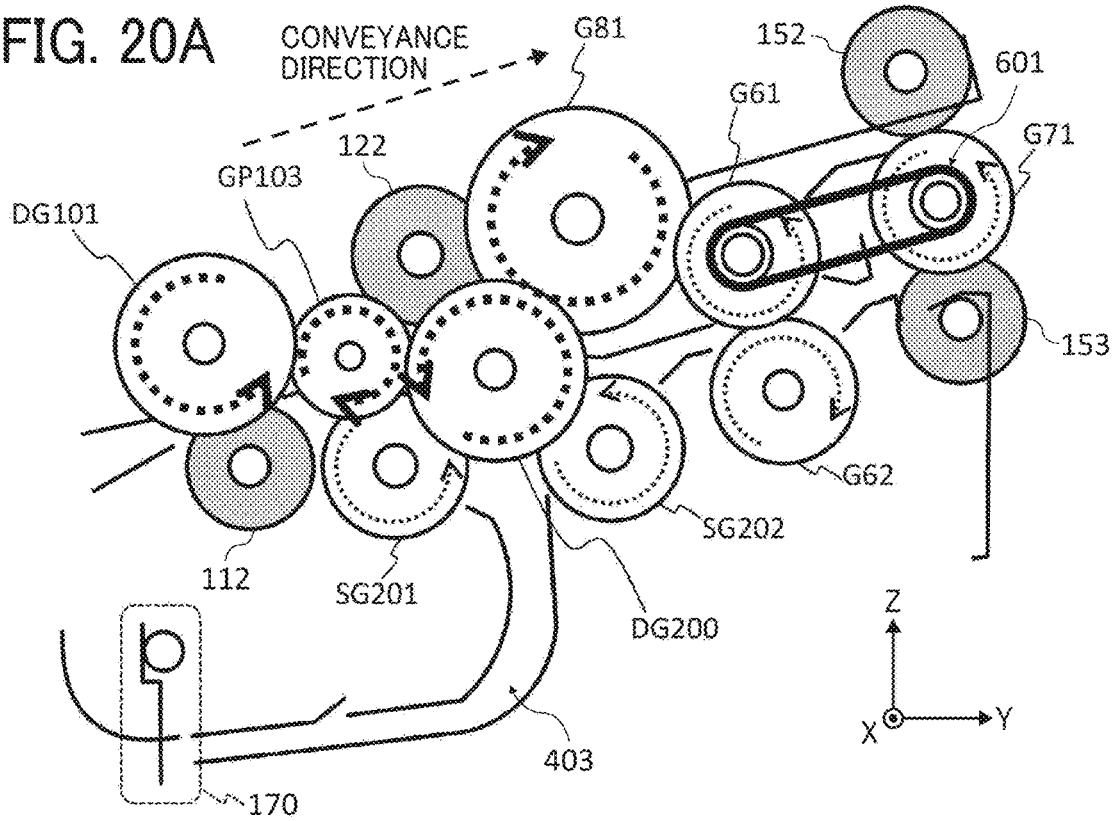
FIG. 20A is a schematic diagram illustrating the drive transmission system in the folding process of the sheet processing unit according to the second embodiment.
Figure 20B:
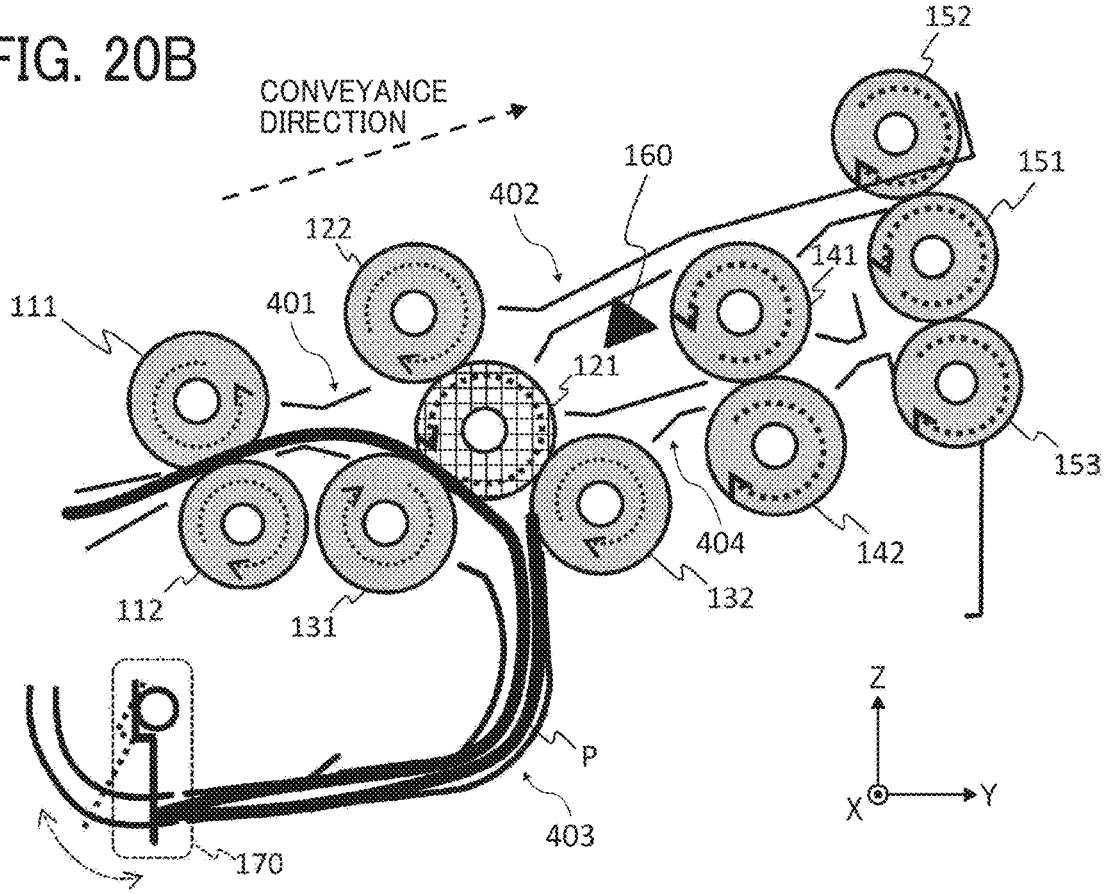
FIG. 20B is a schematic diagram illustrating the conveying roller pairs in the folding process of the sheet processing unit according to the second embodiment.

As illustrated in FIG. 20B, the leading end stopper includes a wall portion that contacts the sheet P and a shaft that fixes and holds the wall portion. The wall portion is rotatable with the shaft as the rotation center. By rotating the wall portion around the shaft to a predetermined position and then fixing the wall portion, the position of the second crease formed on the sheet P can be adjusted according to the type of folding. A leading end of the sheet P contacts the wall portion whose position has been adjusted, and a trailing end of the sheet P is continuously conveyed by the first conveyor 110, the second conveying drive roller 121, and the first folding roller 131. Thus, a bend for folding the second crease on the sheet P is formed in the vicinity of the nip between the second conveying drive roller 121 and the second folding roller 132 in the third conveyance path 403.

Figure 21A:
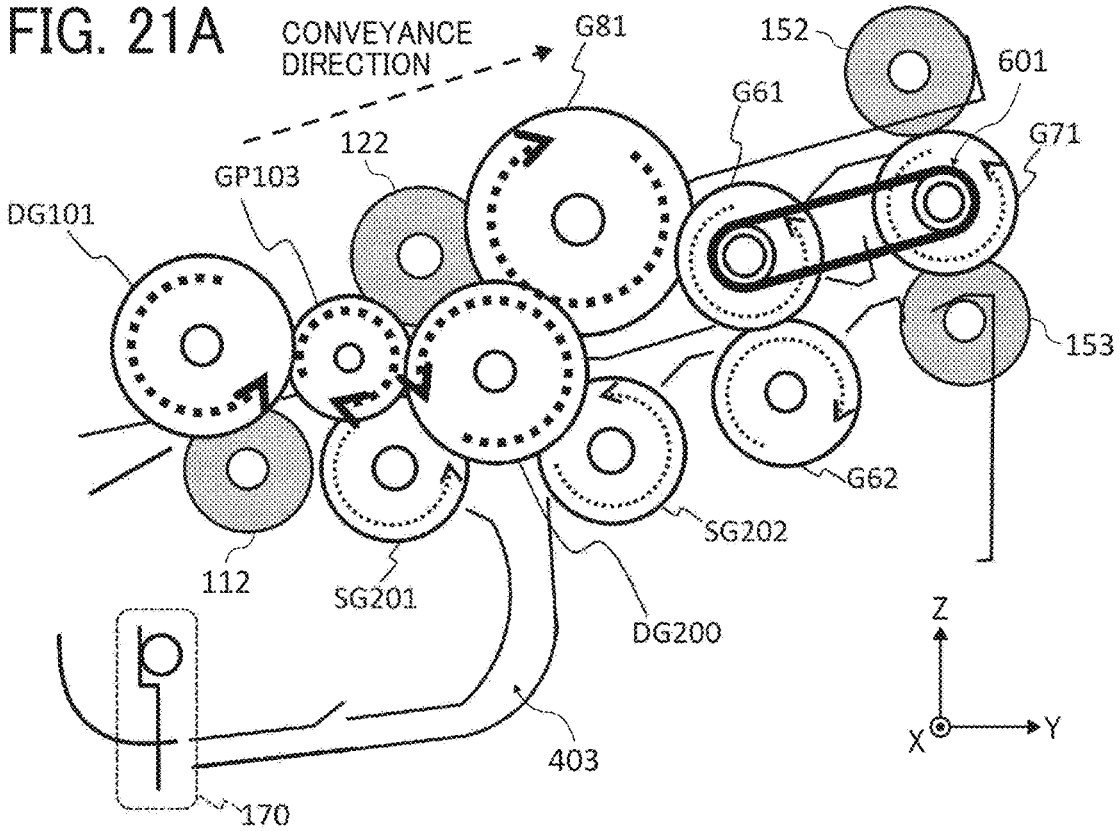
FIG. 21A is a schematic diagram illustrating the drive transmission system in the folding process of the sheet processing unit according to the second embodiment.
Figure 21B:
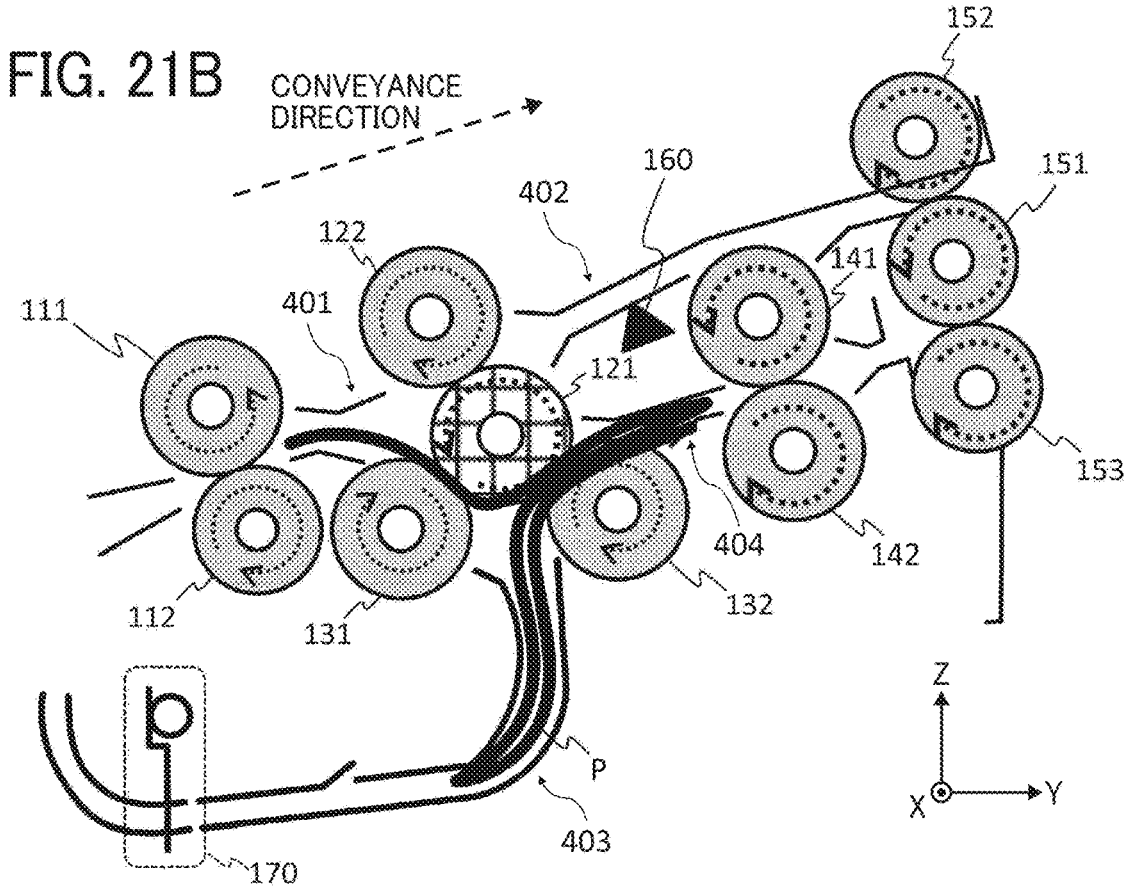
FIG. 21B is a schematic diagram illustrating the conveying roller pairs in the folding process of the sheet processing unit according to the second embodiment.

The bend for forming the second crease formed on the sheet P is inserted into the nip between the second conveying drive roller 121 and the second folding roller 132. Thus, the sheet P is conveyed to the fourth conveyance path 404 in a state in which the second crease is formed on the sheet P as illustrated in FIG. 21B.

Figure 22A:
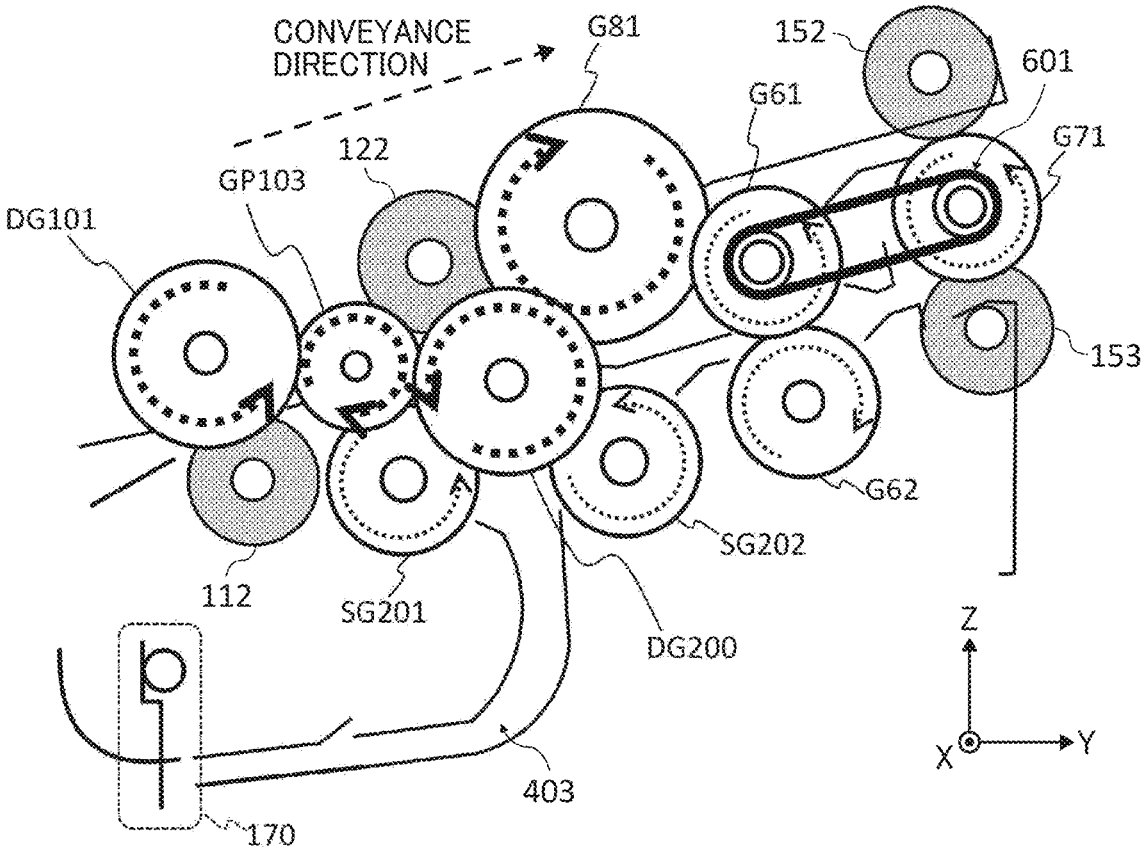
FIG. 22A is a schematic diagram illustrating the drive transmission system in the folding process of the sheet processing unit according to the second embodiment.
Figure 22B:
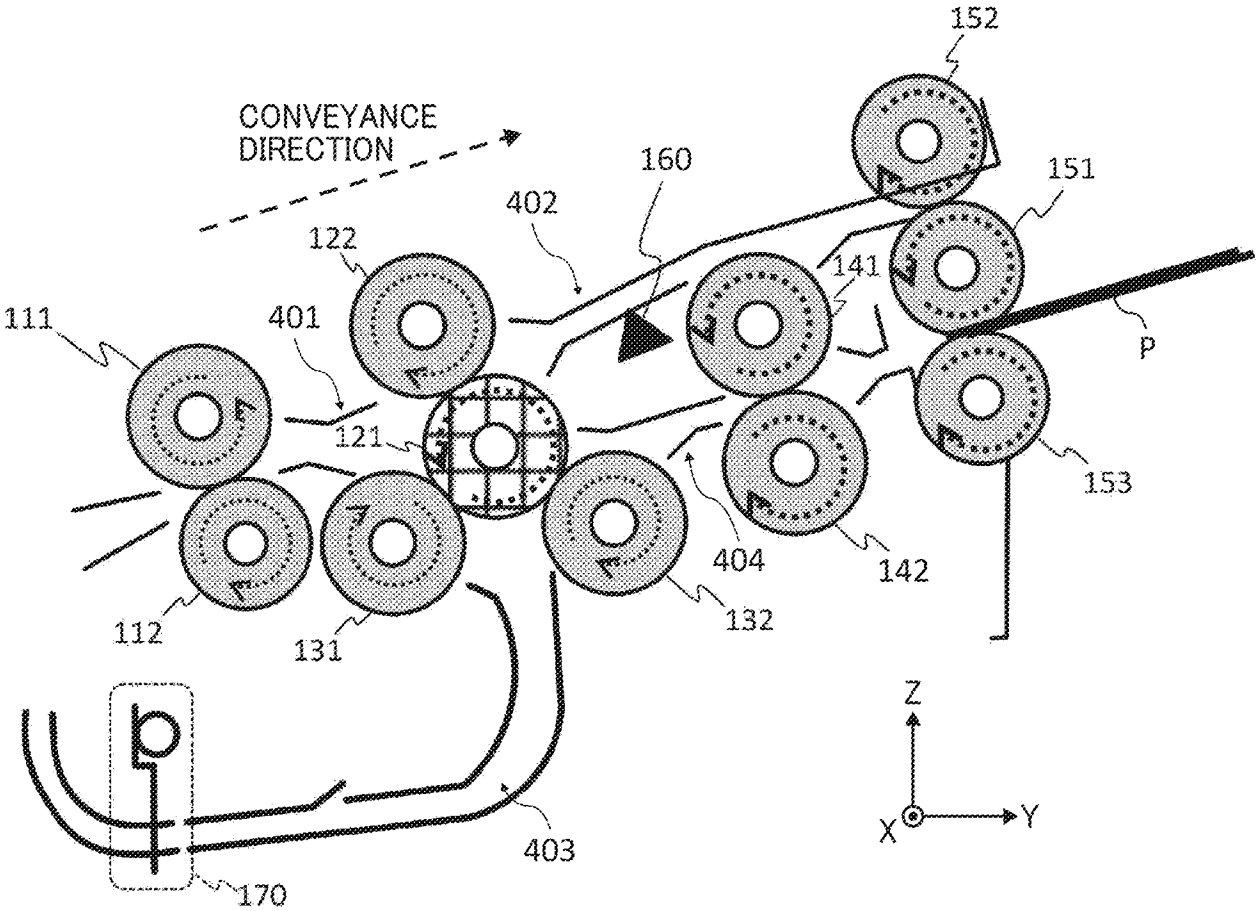
FIG. 22B is a schematic diagram illustrating the conveying roller pairs in the folding process of the sheet processing unit according to the second embodiment.

Thereafter, the sheet P on which the second crease is formed is discharged by the first discharge roller 151 and the second discharge roller 152 constituting the discharge roller section 150 as illustrated in FIG. 22B.

In some embodiments, as illustrated in FIG. 23B, the second sheet detector 170 may be replaced with a combination of a third conveying roller pair 171 and a second forward-reverse rotation sensor 172. In this case, the third conveying roller pair 171 is rotated in reverse to convey the sheet P on which the first crease is formed in the direction opposite to the conveyance direction. When a predetermined time has elapsed since the leading end of the sheet P on which the first crease is formed is detected, the reverse rotation of the third conveying roller pair 171 is stopped. Thereafter, as illustrated in FIG. 23B, the third conveying roller pair 171 is rotated forward to form the second crease on the sheet P in the vicinity of the nip between the second conveying drive roller 121 and the second folding roller 132.

Figure 24:
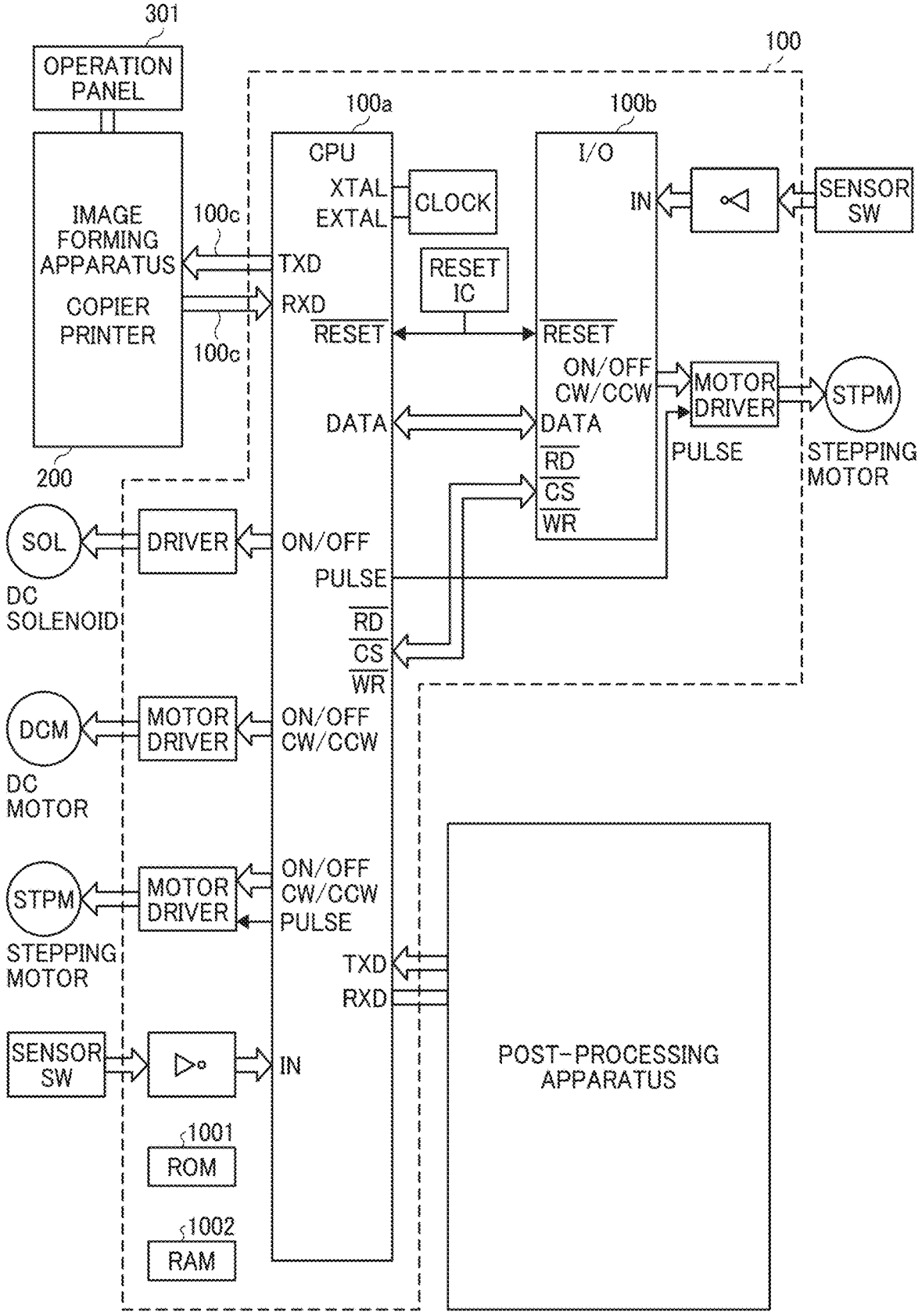
FIG. 24 is a block diagram illustrating a control configuration of an image forming system according to an embodiment of the present disclosure.

FIG. 24 is a block diagram illustrating a control configuration of the image forming system 1000 according to the present embodiment of this disclosure. As illustrated in FIG. 24, the sheet processing unit 100 includes a central processing unit (CPU) 100*a* and a control circuit including a microcomputer having an input-output (I/O) interface 100*b*. The CPU 100*a* receives signals from the CPU 100*a* of the image forming unit 200, each switch of the operation panel 301, and the sheet detection sensors including the first sheet detector 160 and the second sheet detector 170, via a communication interface 100*c*. The CPU 100*a* performs a predetermined control based on a signal input from the image forming unit 200. The CPU 100*a* controls solenoids and motors including the drive motor 180, via drivers and motor drivers for controlling the rotation direction and the rotation speed of the drive motor 180, and acquires the data of the sheet sensors in the printer 1 via the communication interface 100*c*. Further, for example, the CPU 100*a* controls the drive control of the drive motor 180 by the motor driver via the I/O interface 100*b* with respect to the control object, and acquires the data from each sheet sensor. Note that the operation of the sheet processing unit 100 and the operation of the whole printer 1 are controlled by the CPU 100*a* reading program code stored in a read only memory (ROM) 1001 and expanding the program code into a random access memory (RAM) 1002, and using the RAM 1002 as a work area and a data buffer, and are performed based on the program defined in the program code.

In the present embodiment, the folding operation that can be performed by the folding mechanism illustrated in FIG. 2 is instructed and executed by the CPU 100*a* illustrated in FIG. 24.

As described above, the drive transmission system of the sheet processing unit 100 according to the present embodiment includes a plurality of transmission paths of the first drive transmission path TP1 and the second drive transmission path TP2. The driving force transmitted in the first drive transmission path TP1 and the second drive transmission path TP2 is supplied from the drive motor 180. The first drive transmission path TP1 is a transmission path that rotates the second conveyor 120 forward and rotates the first conveyor 110 forward. The second drive transmission path TP2 is a transmission path that rotates the second conveyor 120 in reverse and rotates the first conveyor 110 forward.

The reduction ratios of the drive systems in the two drive transmission paths TP1 and TP2 are adjusted and set, so that the conveying speed of the sheet P by the first conveyor 110 serving as the first conveying roller pair and the conveying speed of the sheet P by the second conveyor 120 serving as the second conveying roller pair can be adjusted.

Figure 25A:
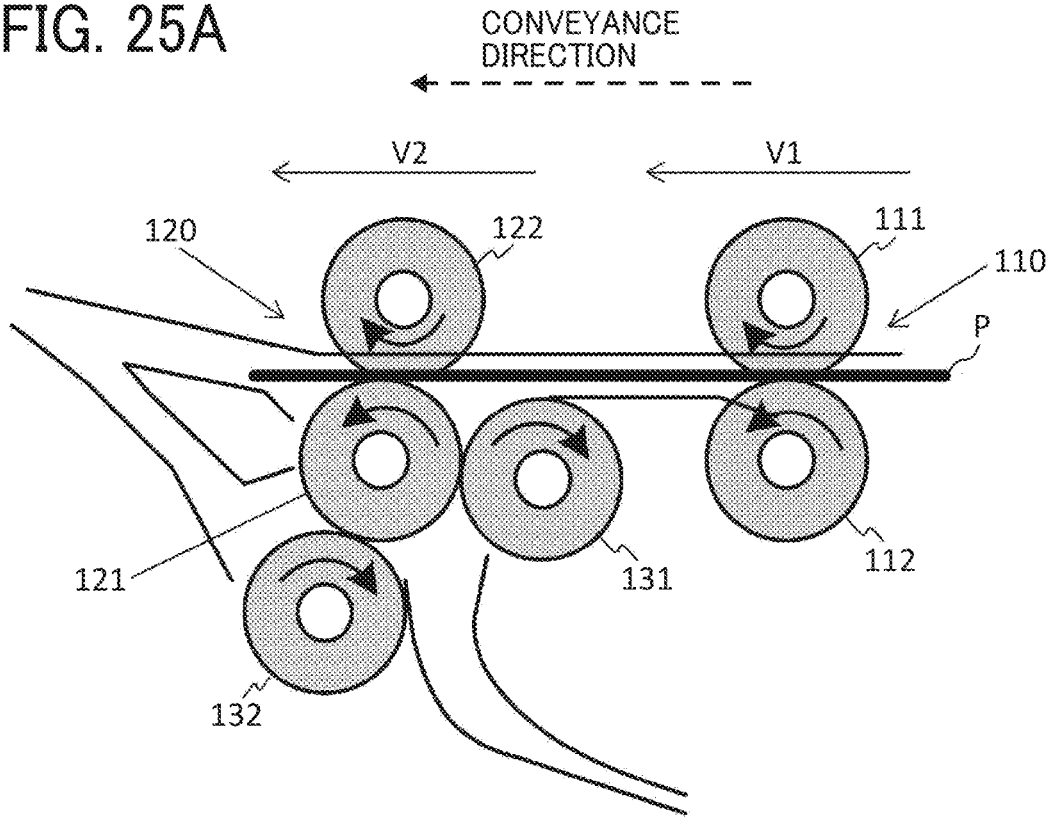
FIG. 25A is a schematic diagram illustrating control of the conveyance speed of a sheet processing unit according to an embodiment of the present disclosure.
Figure 25B:
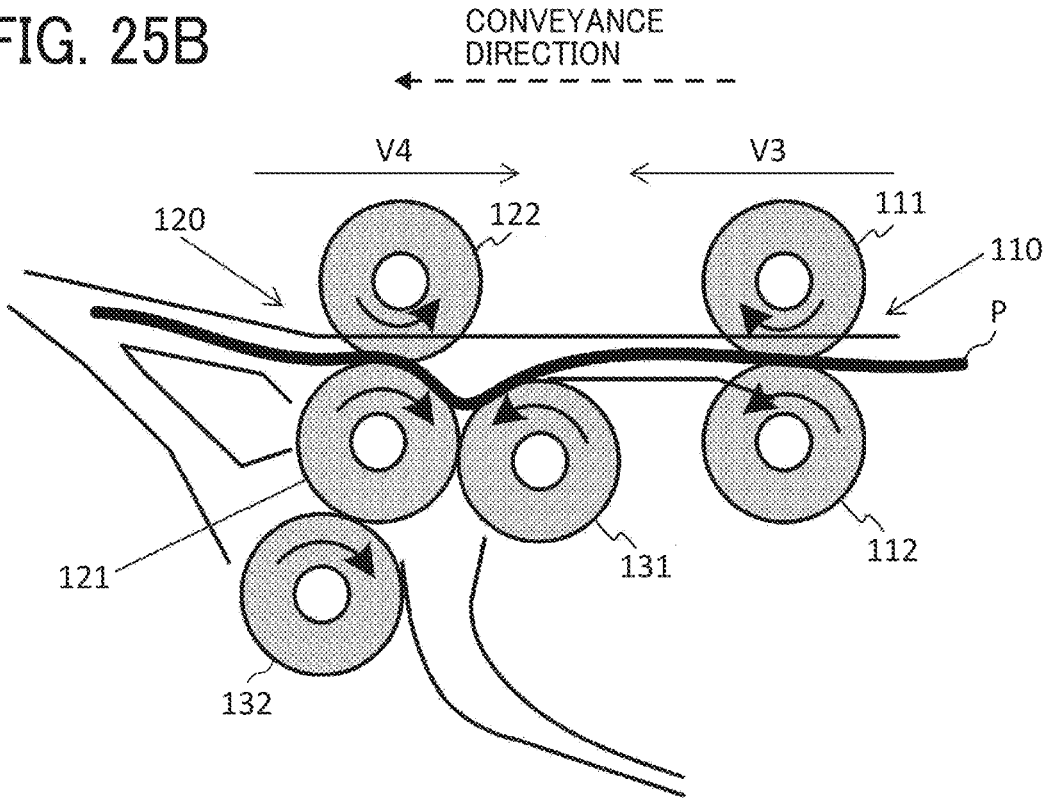
FIG. 25B is a schematic diagram illustrating another control of the conveyance speed of the sheet processing unit illustrated in FIG. 25A.

For example, as illustrated in FIG. 25A, when the first conveyor 110 and the second conveyor 120 are rotated forward, a second conveyance speed V2 of the sheet P by the second conveyor 120 is not higher than a first conveyance speed V1 of the sheet P by the first conveyor 110. When the second conveyor 120 is reversed while the first conveyor 110 rotates forward, a fourth conveyance speed V4 of the sheet P by the second conveyor 120 is not higher than a third conveyance speed V3 of the sheet P by the first conveyor 110.

By adjusting as described above, the folding process can be performed without causing the sheet P to be pulled between the first conveyor 110 and the second conveyor 120 at any of the conveyance timings. The amount of bend of the sheet P between the first conveyor 110 and the second conveyor 120 can be controlled to a certain amount. As a result, the first crease can be accurately formed at a predetermined position on the sheet P.

In the second embodiment, for example, it is assumed that in the drive transmission path for transmitting the driving force to the first-conveying-roller-pair drive gear DG101, the total reduction ratio from the drive motor 180 to the second-conveying-roller-pair drive gear DG200 is 5.56. In this case, the total reduction ratio of the path for transmitting the driving force from the drive motor 180 to the first-conveying-roller-pair drive gear DG101 via the drive transmission idler gear pulley GP103 is set to 5.5. Accordingly, the first conveyance speed V1 can be set to be 1% faster than the second conveyance speed V2. The third conveyance speed V3 is also 1% faster than the fourth conveyance speed V4.

When the size of the sheet P to be folded is A4 size which is one of the specified sizes and the sheet P is folded in three-ply, the conveyance amount is about 90 to 180 mm. The bend generated during conveyance is 0.9 to 1.8 mm Assuming that the dimensional tolerance of the roller diameter of each roller constituting the first conveyor 110 and the second conveyor 120 is ±0.1 mm, even if the roller pair of the first conveyor 110 has a negative tolerance and the roller pair of the second conveyor 120 has a positive tolerance, the relation of V1≥V2 is always satisfied. Accordingly, the sheet P is not pulled between the first conveyor 110 and the second conveyor 120.

As described above, the reduction ratio may be set in consideration of the specifications (e.g., compatible sizes) of the sheet processing unit 100 and the dimensional tolerance of each component so that the amount of bend of the sheet P formed between the first conveyor 110 and the second conveyor 120 does not exceed a certain amount during the conveyance of the sheet P.

Figure 26:
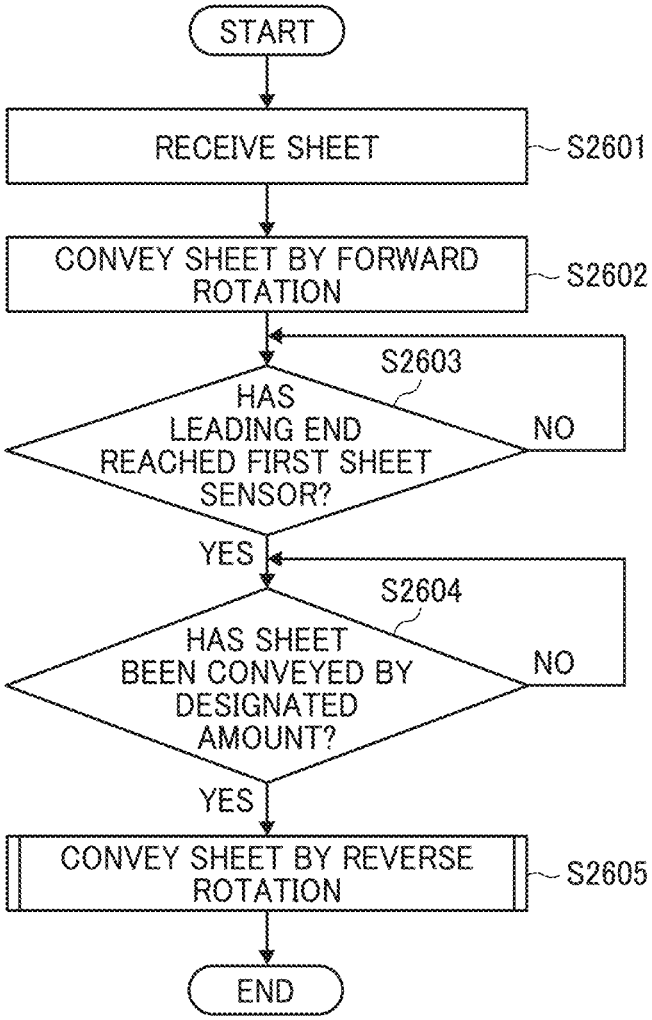
FIG. 26 is a flowchart illustrating a control process of a folding operation in a sheet processing unit according to an embodiment of the present disclosure.

Next, the operation control flows in the sheet processing unit 100 according to the first embodiment and the second embodiment are described with reference to the flowchart in FIGS. 26 and 27. The flowchart described below corresponds to the processing of the control program executed by the CPU 100*a*.

The sheet processing unit 100 receives the sheet P from the image forming unit 200 (S2601). Subsequently, the first conveyor 110 serving as the first conveying roller pair and the second conveyor 120 serving as the second conveying roller pair are rotated forward (S2602). Accordingly, the sheet P is conveyed from the first conveyance path 401 to the second conveyance path 402.

Along with the conveyance of the sheet P, a determination process of whether the sheet sensor of the first sheet detector 160 detects the sheet P is performed (S2603). The conveyance of the sheet P continues until the sheet P is detected by the sheet sensor (S2603: NO). When the sheet sensor of the first sheet detector 160 detects the sheet P (S2603: YES), it is determined whether the sheet P has been conveyed by the designated length L (S2604).

The conveyance of the sheet P continues from the time when the sheet P is detected by the sheet sensor until the sheet P has been conveyed by the designated length L (S2604: NO). When the sheet P has been conveyed by the designated length L (S2604: YES), the second conveyor 120 is reversed. A bent portion of the sheet P is conveyed from the first conveyance path 401 to the third conveyance path 403 so that the sheet P is fold (S2605).

Figure 27:
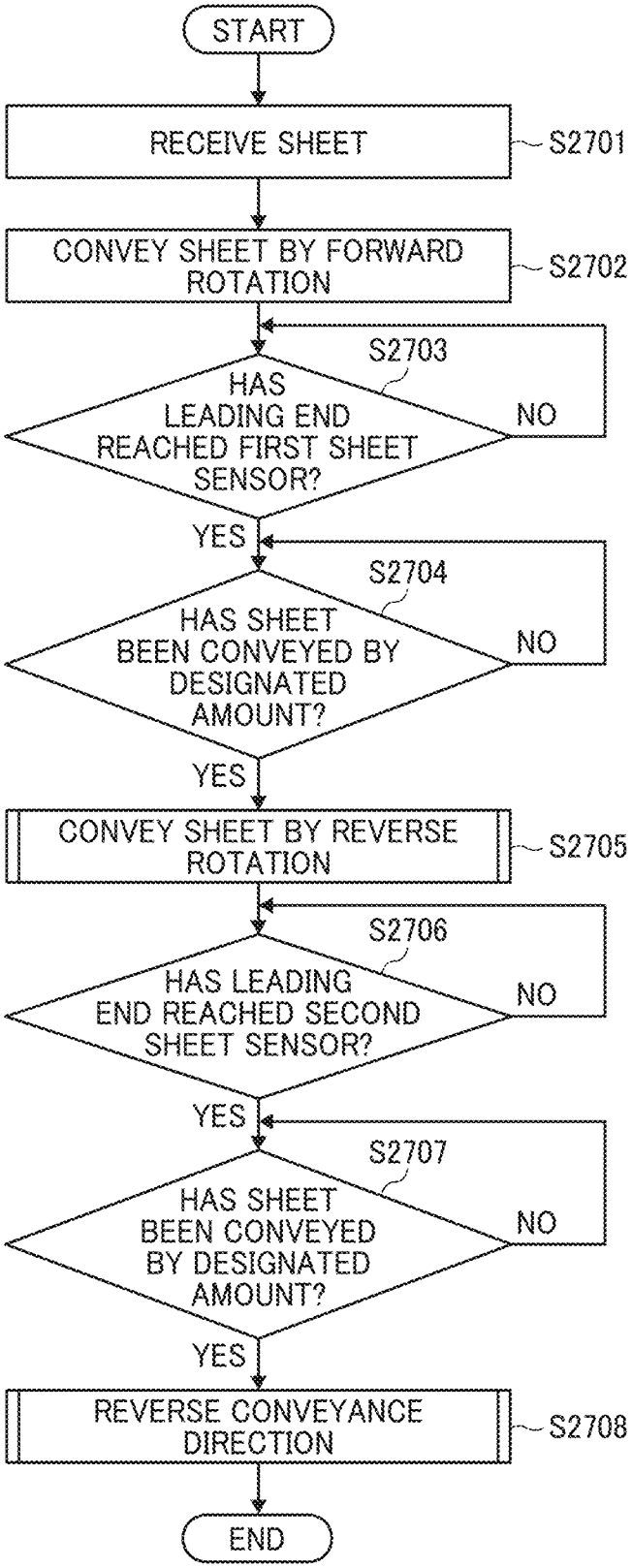
FIG. 27 is a flowchart illustrating a control process of another folding operation in a sheet processing unit according to an embodiment of the present disclosure.

As illustrated in FIGS. 23A and 23B, when the second sheet detector 170 includes the third conveying roller pair 171 and the second forward-reverse rotation sensor 172, the operation control flow is as illustrated in the flowchart in FIG. 27.

In this case, the process from receiving the sheet P from the image forming unit 200 to determining whether the sheet P has been conveyed by the designated length L and the subsequent process until the second conveyor 120 reversely conveys the sheet P are the same as the processes of S2601 to S2605 (S2701 to S2705).

Subsequently, a determination process is performed to determine whether the sheet P conveyed along the third conveyance path 403 is detected by the second forward-reverse rotation sensor 172 (S2706). The sheet P is conveyed in the third conveyance path 403 until the sheet P is detected by the second forward-reverse rotation sensor 172 (S2706: NO). When the second forward-reverse rotation sensor 172 detects the sheet P (S2706: YES), it is determined whether it is the timing of reversing the conveyance of the sheet P (S2707).

When it is the timing of reversing the conveyance of the sheet P (S2707: YES), the conveyance direction is switched again so that the sheet P is conveyed from the third conveyance path 403 to the fourth conveyance path 404 (S2708).

As described above, the sheet processing unit 100 according to the present embodiment exhibits an effect that both downsizing and cost reduction can be realized at the same time.

In the sheet processing unit 100 according to the present embodiment, a predetermined driving force is transmitted to the first conveying roller pair and the second conveying roller pair by the drive motor 180 (serving as the single driving force supply source) and a plurality of drive transmission paths. Thus, the device for folding the sheet P can be miniaturized.

In the sheet processing unit 100 according to the present embodiment, the first conveying roller pair is driven by receiving only the driving force from one side and the driving force in the opposite direction transmitted from each drive transmission path is cut off. Thus, the first conveying roller pair can be driven to rotate in the first direction (i.e., rotate forward) at any time.

In the sheet processing unit 100 according to the present embodiment, even though the rotation of each roller pair is controlled by the driving force supplied from the drive motor 180 serving as the single driving force supply source, the conveyance speed of an upstream portion of a sheet P is adjusted to be faster, thus preventing the sheet P from being pulled in opposite directions during conveyance.

In the sheet processing unit 100 according to the present embodiment, even if the rotation of each roller pair is controlled by the driving force supplied from the drive motor 180 serving as the driving force supply source, the conveyance speed of an upstream portion of the sheet P is adjusted to be faster, thus preventing the sheet P from being pulling from both sides during folding process.

In the sheet processing unit 100 according to the present embodiment, only the driving force in a certain direction can be transmitted by using the one-way clutch, thus allowing the conveying roller pair to appropriately receive the driving force from the two drive transmission mechanisms. This configuration can be achieved with a simple configuration that does not use an electromagnetic clutch or the like.

In the sheet processing unit 100 according to the present embodiment, a simple configuration and an arbitrary reduction ratio can be set depending on the number of teeth of the gears and the timing belt, and the conveyance speed of the sheet by the first conveying roller pair and the second conveying roller pair can be preferably set. Such a configuration can prevent the sheet P from being pulled in opposite directions by a plurality of conveying roller pairs both when the sheet P is conveyed and when the sheet P is folded.

Note that embodiments of the present disclosure are not limited to the specific embodiments described above, and numerous additional modifications and variations are possible in light of the teachings within the technical scope of the appended claims. It is therefore to be understood that the disclosure of this patent specification may be practiced otherwise by those skilled in the art than as specifically described herein, and such variations, modifications, alternatives are within the technical scope of the appended claims.

This patent application is based on and claims priority to Japanese Patent Application Nos. 2021-022618, filed on Feb. 16, 2021, and 2021-197026, filed on Dec. 3, 2021, in the Japan Patent Office, the entire disclosure of each of which is hereby incorporated by reference herein.

REFERENCE SIGNS LIST

1 Printer
100 Sheet processing unit
104 First timing belt
105 First conveying roller pair drive pulley
110 First conveyor
111 First conveying drive roller
112 First conveying driven roller
120 Second conveyor
121 Second conveying drive roller
122 Second conveying driven roller
130 First folding roller section
131 First folding roller
132 Second folding roller
140 Second folding roller section
141 Additional folding drive roller
142 Additional folding driven roller
150 Discharge roller section
151 First discharge roller
152 Second discharge roller
153 Third discharge roller
160 First sheet detector
170 Second sheet detector
171 Third conveying roller pair
172 Second forward-reverse sensor
180 Drive motor
200 Image forming unit
301 Operation panel
401 First conveyance path
402 Second conveyance path
403 Third conveyance path
404 Fourth conveyance path
601 Second timing belt
AG11 First transmission gear
AG12 Second transmission gear
AG13 Third transmission gear
DG101 First conveying roller pair drive gear
DG11 First conveying roller pair drive first gear
DG12 First conveying roller pair drive second gear
DG20 Second conveying roller pair drive gear
DG200 Second conveying roller pair drive gear
G61 Additional folding drive gear
G62 Additional folding driven gear
G71 Discharge drive gear
G81 Drive transmission idler gear
GP103 Drive transmission idler gear pulley
J1 First conveying roller drive shaft
J2 Second conveying roller drive shaft
SG201 Second conveying driven roller first gear
SG202 Second conveying driven roller second gear
TP1 First drive transmission path
TP2 Second drive transmission path

The invention claimed is:

1. A sheet processing apparatus comprising:
a plurality of roller pairs configured to convey a sheet from upstream to downstream in a sheet conveyance direction, the plurality of roller pairs including,
a first roller pair;
a second roller pair downstream from the first roller pair in the sheet conveyance direction; and
a third roller pair between the first roller pair and the second roller pair, the third roller pair configured to form a crease on the sheet;
a single driving force generator configured to supply a driving force to the first roller pair, the second roller pair, and the third roller pair; and
a drive transmission mechanism configured to transmit the driving force to the first roller pair and the second roller pair in a manner such that a rotation direction of the first roller pair is not switched even in a case in which a direction of the driving force is switched such that a rotation direction of the second roller pair is switched when the first roller pair and the second roller pair are driven by the driving force from the driving force generator.

2. The sheet processing apparatus according to claim 1, wherein the drive transmission mechanism includes:
a first drive transmission mechanism configured to rotate the first roller pair in a first direction in response to the second roller pair being rotated in the first direction by the driving force from the driving force generator; and
a second drive transmission mechanism configured to rotate the first roller pair in the first direction in response to the second roller pair being rotated in a second direction by the driving force from the driving force generator.

3. The sheet processing apparatus according to claim 2, wherein
the drive transmission mechanism is further configured to cut off a transmission of the driving force from the second drive transmission mechanism in response to the driving force being transmitted to the first roller pair by the first drive transmission mechanism; and
the drive transmission mechanism is further configured to cut off a transmission of the driving force from the first drive transmission mechanism in response to the driving force being transmitted to the first roller pair by the second drive transmission mechanism.

4. The sheet processing apparatus according to claim 3, wherein each of the first drive transmission mechanism and the second drive transmission mechanism includes a one-way clutch configured to cut off the transmission of the driving force.

5. The sheet processing apparatus according to claim 3, wherein each of the first drive transmission mechanism and the second drive transmission mechanism includes a gear and a timing belt configured to cut off the transmission of the driving force.

6. The sheet processing apparatus according to claim 1, wherein the drive transmission mechanism is further configured to:
transmit the driving force to the first roller pair and the second roller pair such that a first conveyance speed at which the sheet is conveyed in response to the first roller pair being rotated in a first direction by the driving force is not lower than a second conveyance speed at which the sheet is conveyed in response to the second roller pair being rotated in the first direction by the driving force.

7. The sheet processing apparatus according to claim 1, wherein the drive transmission mechanism is further configured to:

transmit the driving force to the first roller pair and the second roller pair such that a third conveyance speed at which the sheet is conveyed in response to the first roller pair being rotated in a first direction by the driving force is not lower than a fourth conveyance speed at which the sheet is conveyed in response to the second roller pair being rotated in a second direction by the driving force.

8. An image forming apparatus comprising:

an image forming device configured to form an image on a sheet; and a sheet processing apparatus according to claim 1, the sheet processing apparatus configured to form a crease on the sheet.

9. An image forming system comprising:

an image forming apparatus configured to form an image on a sheet; and a sheet processing apparatus according to claim 1, the sheet processing apparatus configured to form a crease on the sheet.

* * * * *